United States Patent [19]

Porter et al.

[11] Patent Number: 4,780,744

[45] Date of Patent: Oct. 25, 1988

[54] SYSTEM FOR QUALITY MONITORING AND CONTROL IN AN ELECTROPHOTOGRAPHIC PROCESS

[75] Inventors: Homer G. Porter, Chattanooga, Tenn.; Ralph L. Piccinino, Jr., Rochester, N.Y.

[73] Assignee: Eastman Kodak Company, Rochester, N.Y.

[21] Appl. No.: 16,160

[22] Filed: Feb. 18, 1987

[51] Int. Cl.[4] ..... G03G 15/01; G03G 21/00

[52] U.S. Cl. ..... 355/4; 355/14 R

[58] Field of Search ..... 355/3 R, 4, 14 R, 14 E, 355/14 D

[56] References Cited

U.S. PATENT DOCUMENTS

| | | | |
|---|---|---|---|
| 3,815,988 | 6/1974 | McVeigh et al. | 355/3 R |
| 4,178,095 | 12/1979 | Champion et al. | 355/14 R |
| 4,179,213 | 12/1979 | Queener | 355/14 R |
| 4,183,657 | 1/1980 | Ernst et al. | 355/14 R |
| 4,279,498 | 7/1981 | Eda et al. | 355/14 D |
| 4,313,671 | 2/1982 | Kuru | 355/14 D |
| 4,377,338 | 3/1983 | Ernst | 355/14 D |
| 4,419,010 | 12/1983 | Grombone et al. | 355/133 |
| 4,466,731 | 8/1984 | Champion et al. | 355/14 D |
| 4,502,778 | 3/1985 | Dodge et al. | 355/14 E |
| 4,708,459 | 11/1987 | Cowan et al. | 355/4 |

OTHER PUBLICATIONS

IBM Technical Disclosure Bulletin dated Jan., 1980 (vol. 22, No. 8B) at pp. 3606–3608.

*Primary Examiner*—Fred L. Braun

*Attorney, Agent, or Firm*—Dennis R. Arndt

[57] ABSTRACT

An electrophotographic color proof generating apparatus includes a charger station, an exposure station, a toning station, and a dryer station. A system electronically controls and monitors the quality of the proofs being generated by the electrophotographic process. The process parameters of electrostatic voltage and transmission density are sensed from test patches, sometimes referred to as control patches. The parameters are monitored by the control electronics used to regulate imaging subassemblies and to track film and toner characteristics to provide optimum image density on the photoconductor. It is the purpose of the process control algorithm that resides in the control electronics to control the proofing process to achieve the desired aim transmission density on the photoconductor. The slope of the Density/Delta-V curve and the density (DMAX-NET) are used to predict the working delta-V aim which governs toning control. Any deviation from that density causes the control electronics to adjust the charger grid voltage and the toner electrode bias to bring the test patch back to the required aim density. The voltage read by a first electrometer is an indication of charging efficiency and when compared to the voltage read by a second electrometer, the voltage decay rate may be determined. These electronic voltage readings are used to determine film characteristics of speed and minimum exposure voltage.

9 Claims, 23 Drawing Sheets

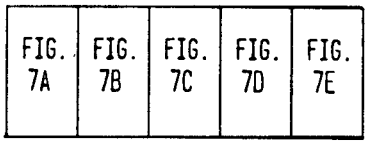
FIG. 14
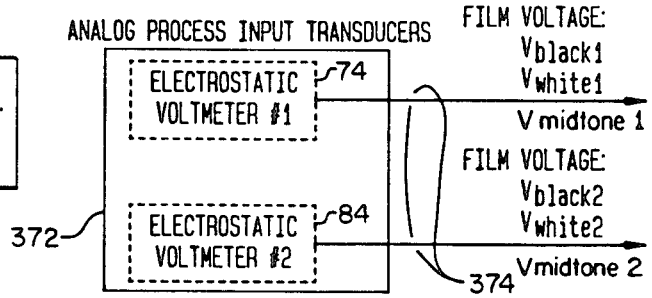
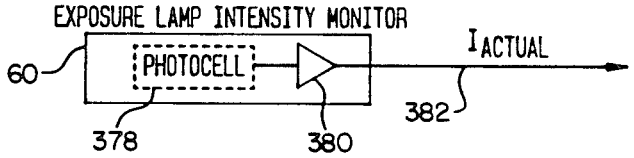
FIG. 14A
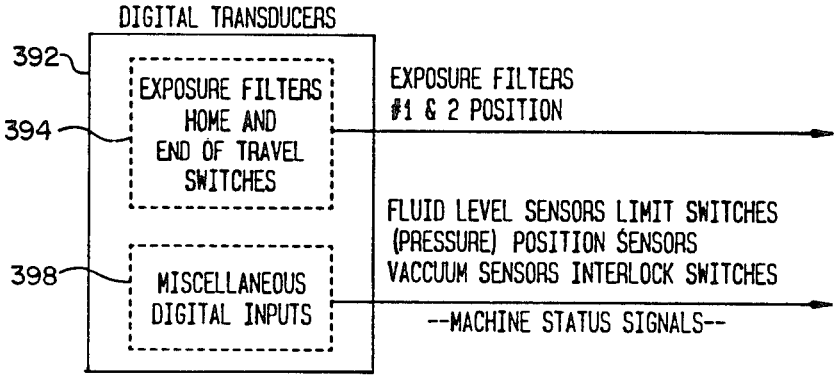
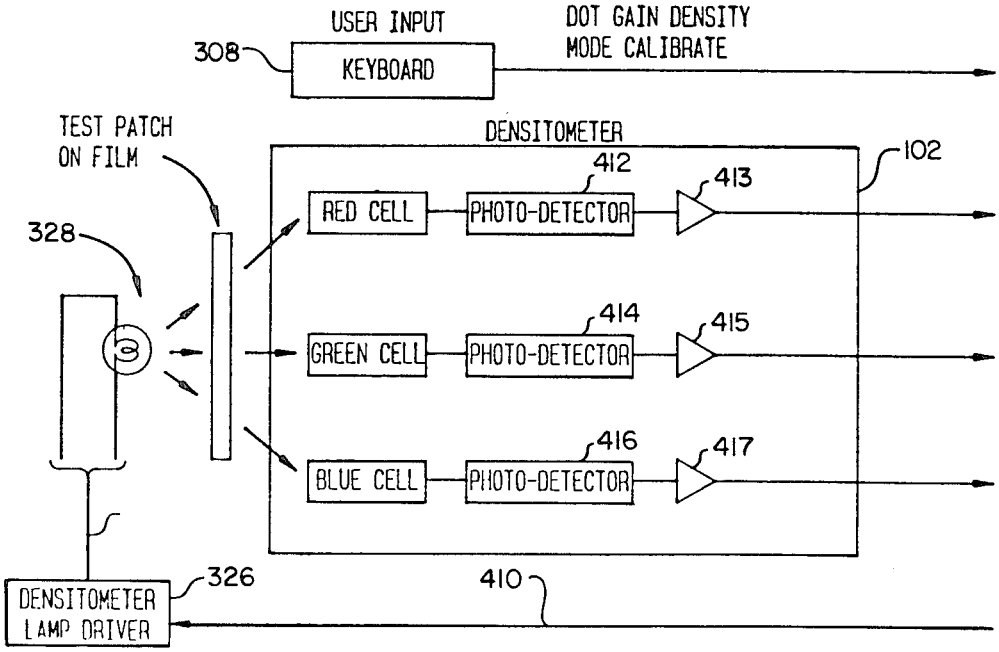

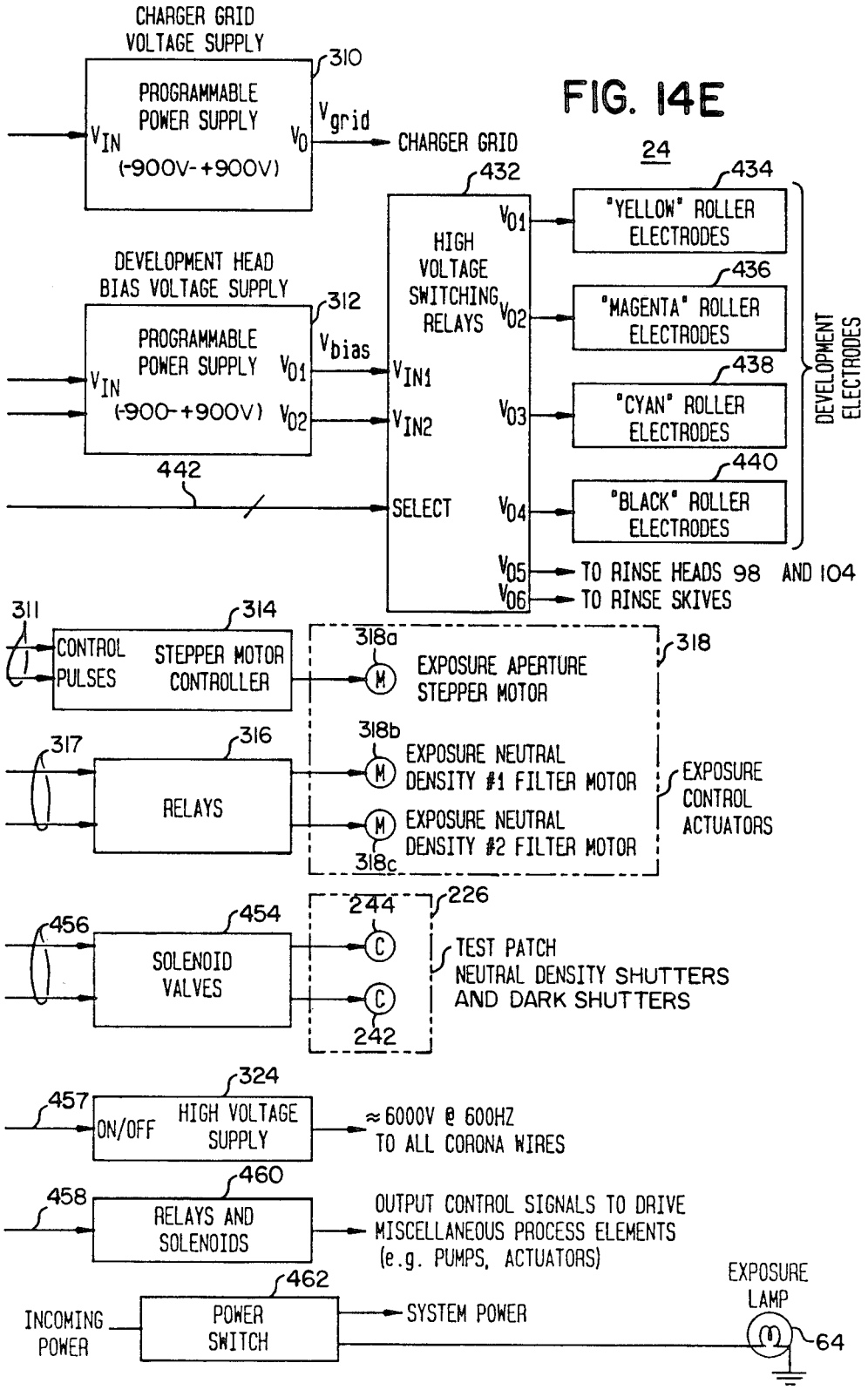
CHARGER GRID VOLTAGE SUPPLY
310
PROGRAMMABLE POWER SUPPLY
$V_{IN}$
$V_0$
$V_{grid}$
(-900V-+900V)
CHARGER GRID
FIG. 14E
24
432
HIGH VOLTAGE SWITCHING RELAYS
$V_{01}$
$V_{02}$
$V_{03}$
$V_{04}$
$V_{05}$
$V_{06}$
434
"YELLOW" ROLLER ELECTRODES
436
"MAGENTA" ROLLER ELECTRODES
438
"CYAN" ROLLER ELECTRODES
440
"BLACK" ROLLER ELECTRODES
DEVELOPMENT ELECTRODES
TO RINSE HEADS 98 AND 104
TO RINSE SKIVES
DEVELOPMENT HEAD BIAS VOLTAGE SUPPLY
312
PROGRAMMABLE POWER SUPPLY
$V_{bias}$
$V_{IN}$
$V_{01}$
$V_{02}$
(-900-+900V)
$V_{IN1}$
$V_{IN2}$
442
SELECT
311
314
CONTROL PULSES
STEPPER MOTOR CONTROLLER
318a
EXPOSURE APERTURE STEPPER MOTOR
318
318b
EXPOSURE NEUTRAL DENSITY #1 FILTER MOTOR
EXPOSURE NEUTRAL DENSITY #2 FILTER MOTOR
318c
EXPOSURE CONTROL ACTUATORS
317
316
RELAYS
456
454
SOLENOID VALVES
244
226
TEST PATCH NEUTRAL DENSITY SHUTTERS AND DARK SHUTTERS
242
457
324
ON/OFF
HIGH VOLTAGE SUPPLY
≈6000V @ 600HZ TO ALL CORONA WIRES
458
460
RELAYS AND SOLENOIDS
OUTPUT CONTROL SIGNALS TO DRIVE MISCELLANEOUS PROCESS ELEMENTS (e.g. PUMPS, ACTUATORS)
462
INCOMING POWER
POWER SWITCH
SYSTEM POWER
EXPOSURE LAMP
64

CALIBRATION PASS ROUTINE 840

SET EXPOSURE ROUTINE

| |
|---|
| FIG. 18A |
| FIG. 18B |
| FIG. 18C |

SYSTEM FOR QUALITY MONITORING AND CONTROL IN AN ELECTROPHOTOGRAPHIC PROCESS

BACKGROUND OF THE INVENTION

1. Field of the Invention

This invention relates to quality monitoring and control of an electrophotographic process and more particularly, to a system that uses data obtained from test patches that are generated as part of the proof being processed. The data derived from monitoring these test patches is used by the control electronics for the automatic adjustment of machine controlled parameters.

RELATED CASES

This applicated is related to U.S. Pat. No. 4,708,459, entitled ELECTROPHOTOGRAPHIC COLOR PROOFING APPARATUS AND METHOD, in the names of C. E. Cowan, A. R. Lubinsky, T. W. Nylund, M. R. Specht and J. P. Spence, issued on Nov. 24, 1987.

DESCRIPTION OF THE PRIOR ART

Contemporary electrophotographic printers and copiers often employ so-called patch sensing techniques for monitoring the level of toner in the developer. These systems establish a test pattern by discharging the photoconductor everywhere except in a discrete path or stripe and thereafter, monitoring the light reflectivity of both the cleaned photoconductor and the patch. Such patches are either placed in the area of the photoconductor outside of the image areas so as not to delay copying operations or are performed by a special cycle to establish the patch in the image area and to test its reflectivity. An unsatisfactory light reflectivity of the patch area causes a response in the form of increased toner introduction or replenishment from a reservoir to a development sump. Systems for performing such operations are shown in U.S. Pats. Nos. 4,178,095; 4,141,645; and 4,065,031.

The replenishment systems referenced above are used to maintain the concentration of powdered toner particles. However, use of this type of toner concentration control scheme does not work well with electrophotographic apparatus that uses liquid toner. When replenishment was used in conjunction with liquid toners, a number of problems were encountered such as concentration imbalances which result in a degradation of image quality. Such concentration imbalances can be the result of poor agitation and/or the result of counter ion formation in the toner.

To avoid the operating difficulties often encountered with automatic replenishment of toner particles, periodic manual replenishment or bath replenishment, as it is sometimes called, has been employed. Batch replenishment requires a given amount of toner be added to the mixture after a given number of toning passes are made. This approach is acceptable providing the amount of toner used for each copy is reasonably predictable. However, if the images being formed contained large solid areas in them, the rate of toner depletion is increased significantly. In addition, it has been found that toner characteristics constantly change under the influence of a number of variables such as toner age, toner usage, degree of agitation, time since last replenishment, and other vagaries of toner behavior. Therefore, in order to maintain the quality and consistency of the toned images, it is necessary that these changes in toner be compensated in such a manner that adjustments in the apparatus will compensate for variations in the toner.

Accordingly, it is a primary object of the present invention to provide a technique of measuring the density versus voltage toner characteristics and use that information to correctly adjust toning parameters to insure highly consistent proof densities associated with high quality toned images.

In addition, it has been found that controlling toner concentration alone addresses only one of the variables which can effect toned density and hence, has been found to be an inadequate control mechanism for an electrophotographic apparatus required to repeatedly produce high quality images.

SUMMARY OF THE INVENTION

An electrophotographic proofing apparatus including a photoconductive surface comprises means for applying a charge potential onto the photoconductive surface, with exposing means for projecting, along an optical path a single color light image from a first color separation, onto the photoconductive surface. Means are also provided for selectively disposing density control members into said optical path during exposure. Means for sensing the potential of the electrostatic latent density test patches recorded on the charged photoconductive surface result in the density controlling shutter members being moved into the optical path during exposure. The sensing means could take the form of an electrostatic voltmeter physically spaced apart with one being located adjacent the charging means and the other in the proximity of the toning means. The difference in the voltage readings sensed by the two electrostatic voltmeters can provide information about how fast the photoconductive surface is losing charge (commonly known as dark decay) as it moves toward the toning station. Toner particles are deposited onto the photoconductive surface complementary in color to a single color electrostatic latent image on the photoconductive surface. The density of at least one of the toned density test patches is measured using, for example, a transmittance densitometer. The outputs of these sensors are used to optimize the processing of the image formed from said first color separation by adjusting the voltage on the developer electrode to an optimum level before the image is developed. The information from these sensors is also fed forward to predict what density of developer will deposit on the photoconductor at various electrostatic voltage levels. The Density/Delta-V curve is updated with the current data and is used on the succeeding pass of that particular color.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows:

FIGS. 14A–14E collectively show a block diagram of the electronic circuitry used in the inventive system;

DETAILED DESCRIPTION

Figure 1:
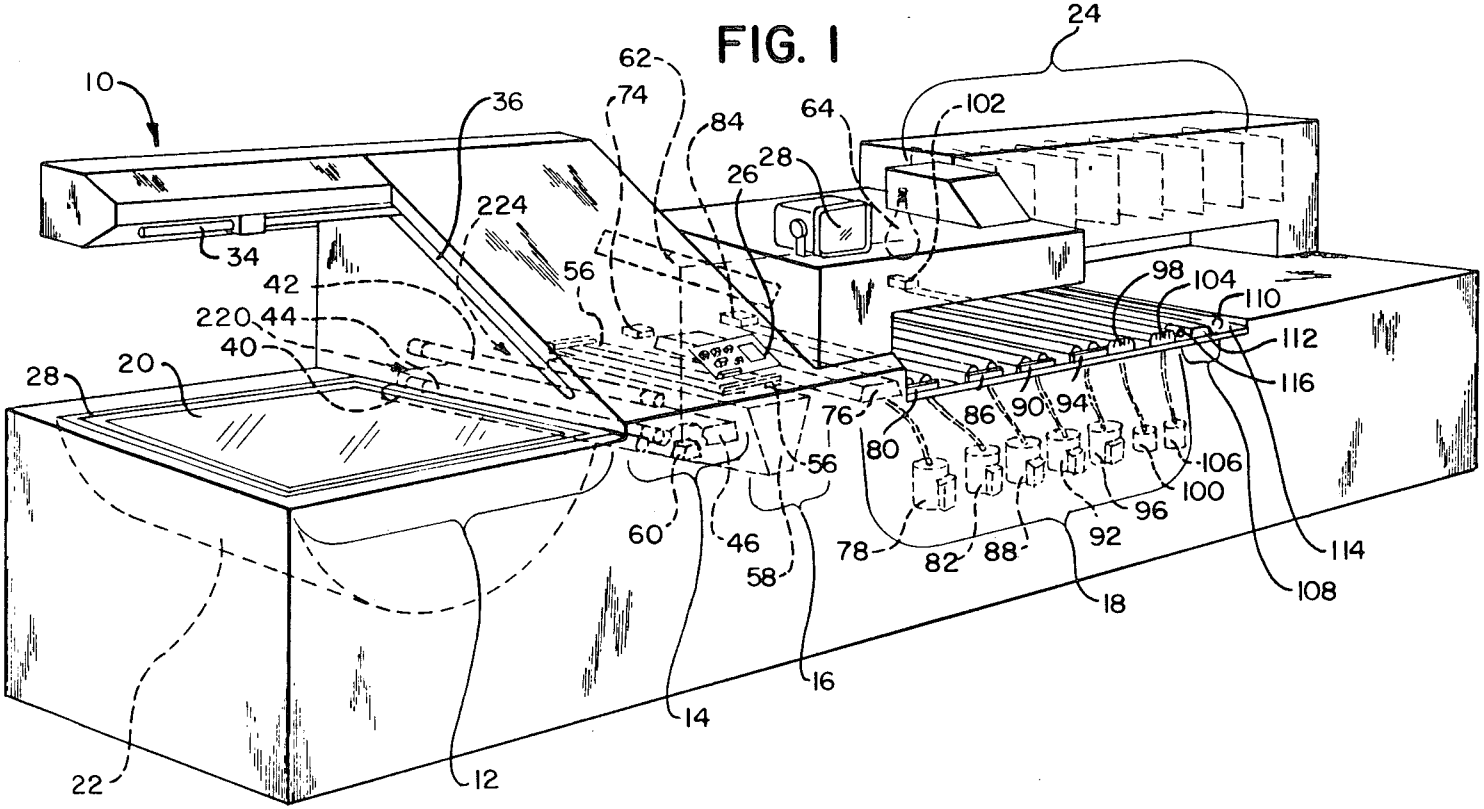
FIG. 1 illustrates a perspective view of an electrophotographic color proof generating apparatus in accordance with the present invention.

Referring now to FIG. 1, there is illustrated a perspective view of an electrophotographic color proof generating apparatus 10 in accordance with the present invention. Apparatus 10 comprises stations 12, 14, 16, 18, 20, and 22, control electronics 24, an operator control panel 26, and a display device 28. It facilitates the relatively rapid generation of a high quality proof (not illustrated) formed on a photoconductive film (PC) (not illustrated in FIG. 1) from a set of half-tone color separations (not illustrated in FIG. 1) (also known as "separations" or "separation films") which are derived from artwork (not illustrated).

Control electronics 24 control light exposure of the PC at station 16, and potentials applied at stations 14 and 18 such that a proof generated by apparatus 10 on a PC has both a preselected density and dots having essentially the same size as dots of a press sheet printed on a commercial printing press. Printing plates not illustrated of a commercial press (not illustrated) are derived from the same separations used to generate the proof. The new proof is then compared to the artwork. This procedure is repeated until a proof generated by apparatus 10 is an acceptable reproduction of the artwork. The separations used to generate the acceptable proof are then used to form press plates for the commercial press. A press sheet is then printed on the commercial press. The press sheet so printed will be an acceptable reproduction of the artwork since the proof is calibrated to the press sheet and the proof is an acceptable reproduction of the artwork.

Station 12 comprises a platen 30 which is essentially a flat glass member mounted on a metal frame which is part of a horizontally movable carriage. Station 12 also comprises a semicylindrical member 22 having an opening disposed below platen 30, a lift arm 34, a slot opening 36, platen end clamps (not illustrated) to hold down a PC, and grounding clamps (not illustrated) which penetrate to a conductive (ground) layer of the PC. Member 22 is situated such that platen 30 can be selectively rotated 180 degrees. Platen 30 further comprises a groove 28 therein to which a vacuum line (not illustrated) can be attached to cause a separation and a PC placed on platen 30 to closely adhere to each other and to the glass portion of platen 30. The PC is placed on platen 30, the grounding clamps are activated, and lift arm 34 lifts on edge of the PC. A separation is placed under it. The PC is then lowered, the platen end clamps are activated, and a rubber roller (not illustrated) is rolled over the PC and separation to cause any air trapped therebetween to move to the outer edges where it is removed through groove 28. Platen 30 is then rotated 180 degrees through 22. Station 12 may be denoted as the load/unload station or load/unload position.

Station 14 comprises an autobuff roller 40, upper 42 and lower 44 light erase fluorescent lamps, and a charger apparatus 46. Autobuff roller 40 is a roller whose position is selectively adjusted so as to make contact with and clean off a PC as it passes station 14. Examples of autobuff rollers useful with apparatus 10 are given in U.S. patent application Ser. No. 837,973 filed Mar. 10, 1986, now U.S. Pat. No. 4,660,503, entitled "METHOD AND APPARATUS FOR IMPROVING A MULTICOLOR ELECTROPHOTOGRAPHIC IMAGE" in the name of R. S. Jones, which is co-pending with the present application and in which there is a common assignee. Upper 42 and lower 44 lamps are selectively turned on to cause a PC which was previously charged by portions of apparatus 10 to be discharged.

Figure 2:
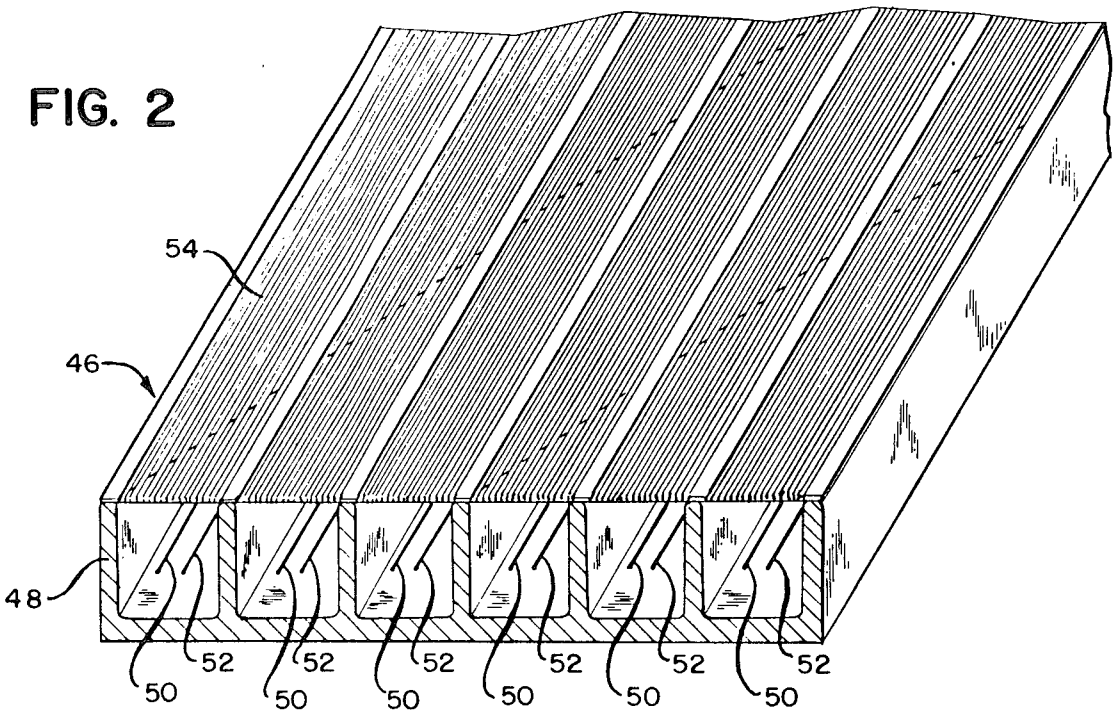
FIG. 2 is a schematic diagram illustrating further details of the corona charging station used in the apparatus shown in FIG. 1.

Charger apparatus 46 is used to place a charge on a PC film. An exploded cross-sectional view of part of charger apparatus 46 is illustrated in FIG. 2. Charger apparatus 46 comprises a support member 48 having six U-channels with each U-channel having first and second corona wires 50 and 52 suspended therein and a grid of closely spaced and electrically connected grid wires 54 covering an open portion of the six U-channels. Corona wires 50 and 52 are, in a preferred embodiment of charger apparatus 46, coupled to a high voltage, current controlled 600 Hz power source and serve as a source of ions which are controlled by an electric field created when a potential is applied to grid wires 54. These ions are collected on a surface of the PC which passes over charger apparatus 46 during the operation of apparatus 10. Charger apparatus 46 has been found to be very efficient in that same delivers an essentially uniform charge onto a surface of the PC which results in the PC surface being set to essentially the potential level, $V_{grid}$. $V_{grid}$ is the potential applied to the grid wires 54 of charger apparatus 46. The basic operation of chargers of this general type is well known and is discussed in U.S. Pat. No. 3,527,941, issued Sept. 8, 1970 and assigned to a common assignee. Charger apparatus 46 may also be denoted as a charging means.

Figure 3:
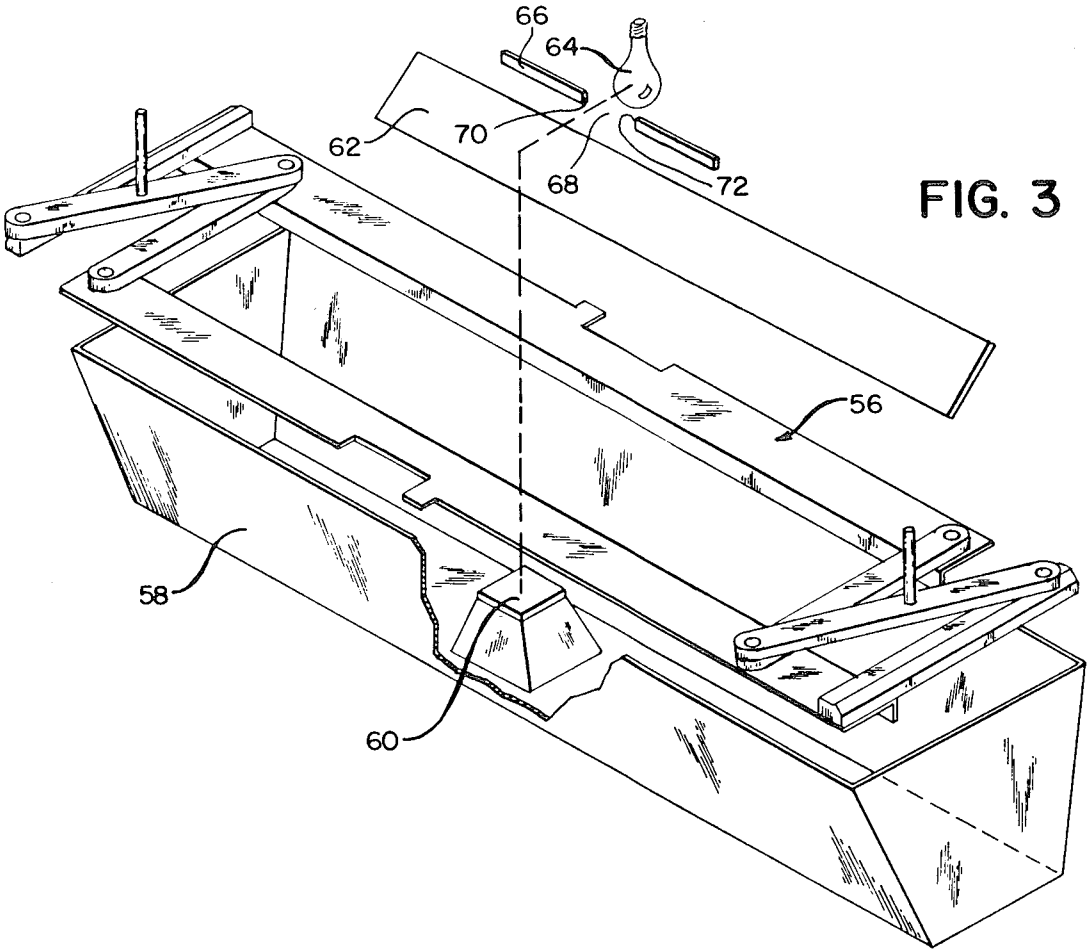
FIG. 3 is a schematic diagram illustrating in more detail the exposure station used in the apparatus shown in FIG. 1.

Station 16, which is also illustrated in enlarged form, comprises a shutter apparatus 56, a V-groove chamber 58, a light intensity monitor 60, a mirror 62, and a light source 64. Station 16 also includes a mask 66 (illustrated in FIG. 3) which has an aperture 68 defined by edges 70 and 72. Mask 66 controls the passage of light emitted by light source 64. Light emitted by light source 64 passes through aperture 68 of mask 66 and is then reflected by mirror 62 downward through the glass portion of platen 30 and through a separation and PC mounted on 30. V-groove chamber 58 has a light intensity monitor 60 centrally located therein. Light intensity monitor 60 is adapted to provide an output electrical signal which is coupled to control electronics 24. Control electronics 24 provide control signals which cause a motor (not illustrated) to open or close shutter apparatus 56 so as to regulate the amount of light incident on a PC passing under shutter apparatus 64. Control electronics 24 also control the speed of platen 30 as it passes under shutter apparatus 56 and control filters (not illustrated) which can be placed in front of light source 64 to modify the amount of light which reaches a PC.

Station 18 comprises a first electrometer (also known as an electrostatic voltmeter) 74, prewetting apparatus 76 and a pump and reservoir 78 for same, first development electrode-toner apparatus 80 and a pump and reservoir 82 for same, a second electrometer (also known as an electrostatic voltmeter) 84, second development electrode-toner apparatus 86 and a pump and reservoir 88 for same, third development electrode-toner apparatus 90 and a pump and reservoir 92 for same, fourth development electrode-toner apparatus 94 and a pump and reservoir 96 for same, first rinse apparatus 98 and a pump and reservoir 100 for same, a densitometer 102, and a second rinse apparatus 104 and a pump and reservoir 106 for same. Apparatus 80, 86, 90, and 94 are denoted as a development toner station or development means.

Prewetting apparatus 76 selectively causes a liquid, typically ISOPAR G, which is a trademark of Exxon, to coat a PC film which passes over 76. Apparatus 80, 86, 90, and 94 hold yellow, magenta, cyan and black colored toner, respectively, and each comprise first and second roller-electrodes which are selectively held at a potential, $V_{bias}$, determined and controlled by control electronics 24. During a cycle of use of apparatus 10 when toner is applied to a PC, only one of the development apparatus is positioned to allow toner contained therein to be applied to a PC. It thus takes four cycles of operation of apparatus 10 to apply each of the four different colors of toner to a PC.

Electrometers 74 and 84 measure the potential of selected test patch areas of a PC film as the PC film passes by each of same. Output voltage readings of electrometers 74 and 84 are coupled to the control electronics 24 which use this information to control the potential, $V_{grid}$, applied to a PC by charger apparatus 46 and to control a potential $V_{bias}$ applied to the two roller electrodes of each the development electrode-toner apparatus.

Densitometer 102 measures the transmission density of test patch areas on a PC as these areas of the PC move over densitometer 102. Output signals from 102 are coupled to control electronics 24. Control electronics 24 adjust $V_{grid}$ and $V_{bias}$ such that apparatus 10 generates a proof having a solid area density which is the same as is desired. Each of the development electrode-toner apparatus has a skive (not expressly illustrated) which is adapted to allow a jet of air to be shot up against the film so as to remove excess toner (not illustrated) which then falls into a receiving portion of the development apparatus and is collected.

Each of rinse apparatus 98 and 104 has central slits through which a liquid, typically ISOPAR G, flows onto a surface of a PC to remove excess toner. Excess toner and ISOPAR G flow through parallel channels (not illustrated) which empty into reservoirs 100 and 106. Each of 98 and 104 has a skive (not illustrated) therewith which removes excess toner and ISOPAR G.

Station 108 comprises blotter roller 110 which removes wet toner from the trailing platen end clamp (not illustrated), and air drying apparatus 112 which directs a stream of air at the PC passing thereover to dry the PC.

Station 114 comprises lower light erase apparatus 116. Lower light erase apparatus 116 is positioned below the platen 30 when platen 30 passes station 114. Lower light erase apparatus 116 is typically a fluorescent lamp which is selectively turned on to equalize potentials across the PC.

Operation

Figure 4:
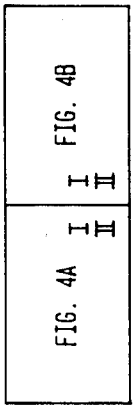
FIG. 4 is a diagram showing the proper alignment of the drawing sheets of FIGS. 4A and 4B.
Figure 4B:
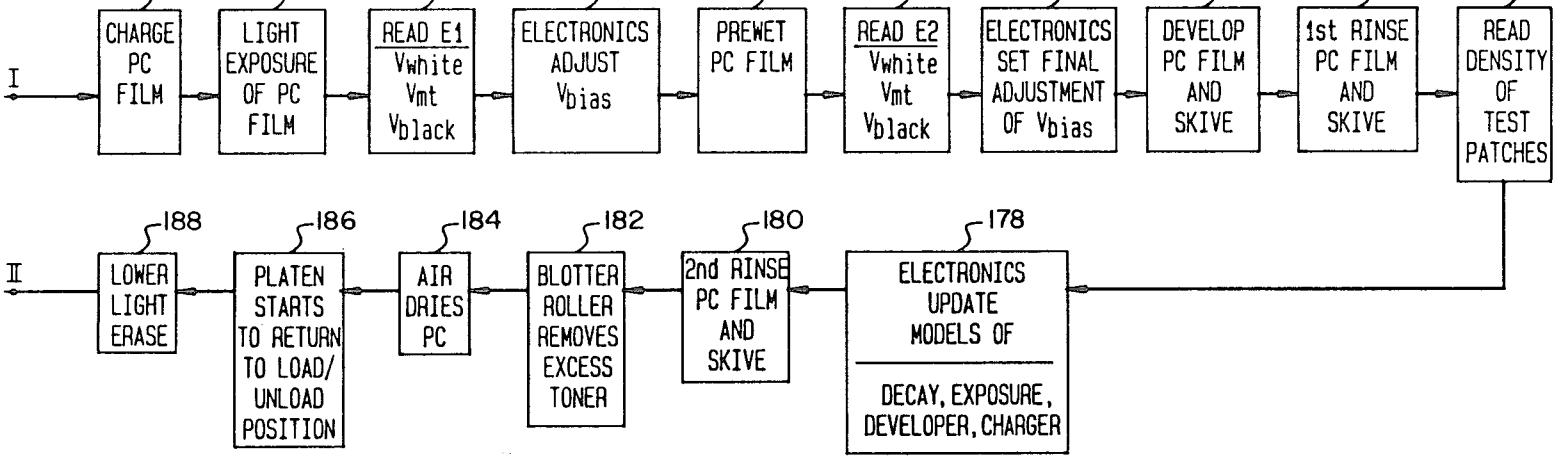
FIGS. 4A and 4B collectively illustrate a flow chart in accordance with the present invention.
Figure 4A:
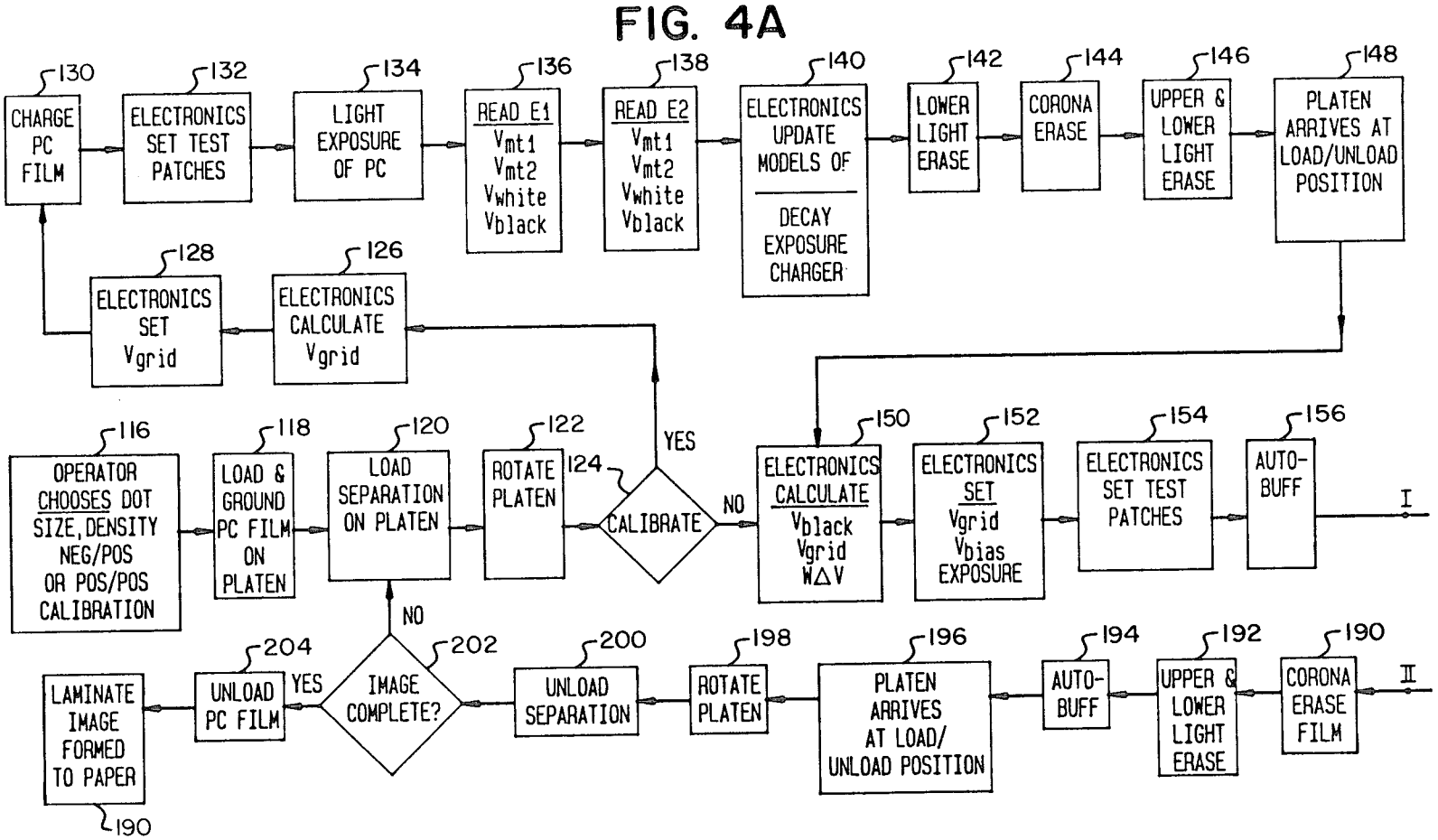

The operation of apparatus 10 is illustrated in the flowchart of FIGS. 4A and 4B which are connected together as illustrated in FIG. 4.

The PC is first placed on platen 30 and grounded by clamps which electrically connect a conductive layer thereof to apparatus 10 as indicated in box 118. Lift arm 34 is activated and brought down to the front edge of the PC. The front edge of the PC is attached by a vacuum to lift arm 34. Then lift arm 34 is returned to the position illustrated in FIG. 1. Typically, the black separation is first placed in a preselected portion of platen 30 as indicated in box 120 and then lift arm 34 is lowered. The end of the PC held by lift arm 34 is released and laid down on 30. The PC/separation package is drawn into intimate contact with the platen glass under vacuum. The operator uses a roller to force any trapped air pockets from the interface. Platen 30 is now rotated 180 degrees as is indicated in box 122. The decision to use a calibrate run has been elected and therefore the YES path of box 124 is elected. Control electronics 24 calculate the grid voltage $V_{grid}$ of charging apparatus 46 as is illustrated in box 126. Since this is a first run a number in a memory table of control electronics 24 is used. Control electronics 24 then set the grid 54 of charger apparatus 46 to the selected potential as is indicated in box 128.

Platen 30 now starts to travel at a speed which is controlled by control electronics 24 from station 12 towards station 14. Autobuff apparatus 40 is lowered and does not contact the PC at this point and upper 42 and lower 44 light erase apparatus are turned off. A photoconductive layer of the PC starts to be charged to essentially $V_{grid}$ as it passes above charging apparatus 46. As the PC completes its movement by 46, a surface thereof is essentially uniformly charged to the potential $V_{grid}$ as is illustrated in box 130. Control electronics 24 now move shutter members on platen 30 so as to allow to complete exposure of some test patch areas, to allow only partial exposure of others, and to not allow any exposure of still others as is illustrated in box 132. This will be discussed in greater detail below. Platen 30 is now moved to station 16 and the PC film is exposed in areas that are not masked by the shutter member on the black separation as illustrated in box 134. The exposed areas drop in potential while the masked areas stay close to $V_{grid}$. The charge on the PC continues to decay as it moves beyond station 16.

Prewetting apparatus 76 is deactivated during the calibration cycle as are the four development electrode-toner apparatus 80, 86, 90, and 94, the rinse apparatus 98 and 104, the air drying apparatus 112, and blotter roller 110.

As the PC passes electrometer 74, voltage readings of the test patch area $V_{mt1}$(middle-tone voltage 1, also referred to as $V_{MID}$), $V_{mt2}$(middle-tone voltage 2), $V_{white}$ (the voltage in completely exposed areas, also referred to as $V_{MIN}$), and $V_{black}$ (the voltage in non-exposed areas, also referred to as $V_{MAX}$) are taken as indicated in box 136. The PC passes the yellow development apparatus 80 and then passes electrometer 84 which measures the voltages of the same test patch areas as indicated in box 140. There is some drop in voltage between the two separated electrometers as the PC charge decays somewhat with time. The voltage readings at both electrometers are coupled to the control electronics 24.

Control electronics 24 now update mathematical models of voltage drop because of charge decay on the PC, of exposure variations, and of the charger variations as is illustrated in box 140. These models and the calculations performed will be discussed in further detail hereinbelow.

Platen 30 now changes direction and the PC now passes lower light erase apparatus 116 which is now turned on and tends to equalize potentials over all areas of the PC. This operation is illustrated in box 142. It then moves back to station 14 where it passes over charging apparatus 46 as is indicated in box 128. The sign of the potential applied to the grid 54 is reversed. This reverses the electrical field in the PC. The PC then passes by the upper 42 and lower 44 light erase apparatus which are now on and cause the PC to be discharged essentially back to the charge state it had when it was placed on platen 30 as is illustrated in box 146. This is known as corona erase which is described in more detail in U.S. patent application Ser. No. 839,009 filed Mar. 12, 1986, now abandoned entitled "METHOD AND APPARATUS UTILIZING CORONA ERASE FOR IMPROVING A MULTI-COLOR ELECTROPHOTOGRAPHIC IMAGE", in the names of A. Buettner et al, and which is co-pending with the present application and in which there is a common assignee. The platen continues to move and arrives back at the load/unload position (station 12) as is illustrated in box 148. Control electronics 24 now calculate the voltages $V_{black}$, $V_{grid}$, and $W\Delta V$ as is illustrated in box 150, and set the exposure, and voltages $V_{grid}$ and $V_{bias}$ as is indicated in box 152, and set up the test patch areas on the side of the PC as indicated in box 154 for a first image forming run using the black separation.

Platen 30 now moves from station 12 to station 14 and past the autobuff roller 40, which is in a lowered position and does not contact the PC. It then moves through charger apparatus 46 which places a uniform charge on the PC as is indicated in box 158. Platen 30 then arrives at station 16 at which the PC is exposed to light as is indicated in box 160. It then moves past electrometer 74 where readings of $V_{white}$, $V_{mt}$, and $V_{black}$ are taken in the test patch areas of the PC as is indicated in box 162. Control electronics 24 now adjust $V_{bias}$ as is indicated in box 164. The PC is then wet with ISOPAR G by prewetting apparatus 76 as is illustrated in box 166. Platen 30 then moves past electrometer 84 which reads $V_{white}$, $V_{mt}$, and $V_{black}$ as is indicated in box 168. Electrometer 84 is not used when the yellow toner is being developed but is used for the three other colors. Control electronics 24 now calculate and set a new value for $V_{bias}$ as is illustrated in box 170. The value for $V_{bias}$ set in box 164 is the value used when the yellow toner is being deposited on the PC.

The PC passes over the yellow, magenta, and cyan development electrode-toner apparatus 80, 86, and 90, which are deactivated at this time, and then to black development electrode-toner apparatus 94 which is activated. At 94 the PC receives black toner which is developed onto the PC, and excess toner is skived off the PC as is illustrated in box 172. The PC now passes first rinse apparatus 98 which rinses off excess toner and skives the PC as is illustrated in box 174. The PC now passes densitometer 102 which reads the densities of the test patch areas of the PC as is illustrated in box 176. These readings are coupled to control electronics 24. Control electronics 24 now update the models of the decay, exposure, developer and charger as is illustrated in box 178.

The PC now passes over second rinse apparatus 104 which performs the same function as first rinse apparatus 98. This operation is illustrated in box 180.

The PC now passes over blotter roller 110 and then air drying apparatus 112 as is illustrated in boxes 182 and 184, respectively. Lower erase light 116 is off as platen 30 passes. After platen 30 reverses direction, as indicated in box 186, lower erase light 116 is turned on. Lower erase light 116 tends to equalize the potentials of all areas of the areas of the PC as is illustrated in box 188.

The PC now moves back to the charging apparatus 46 where the voltage on grid 54 is reversed in polarity so as to reverse the electrical field in the PC as is illustrated in box 190. The PC now moves between the upper 42 and lower 44 erase lights that are now turned on and cause the PC to be discharged to essentially the same state as existed at the time it was placed on platen 30 as is illustrated in box 192. Autobuff roller 40 is in a lower position at this time and during a return of the PC is used only after the last color (in this case cyan) is placed on the PC as is illustrated in box 194.

Platen 30 now arrives back at its initial position as is illustrated in box 196. Platen 30 is then rotated 180 degrees as is illustrated in box 198. The black separation is then removed as is indicated in box 200. This operation of developing one color is known as a toning pass. Box 202 illustrates that the PC image is reviewed and that either another separation is to be added, as is illustrated in box 120, or the image on the PC is complete and the PC is unloaded as is illustrated in box 204.

For the operation described up to this point only the black toner is on the PC and therefore a second separation, typically the yellow separation, is loaded on platen 30. The flowchart process illustrated is repeated but the portion of the flowchart which is used to initially calibrate is omitted. Autobuff roller 40 is in a raised position and is used before the PC enters the charging apparatus 46 for all but the first toning pass, as is illustrated in box 156. The magenta and cyan separations are subsequently used in the same manner until the image is fully formed on the PC.

After all the four colors have been formed on the PC, it is then laminated to paper as is indicated in box 190. The lamination occurs in one illustrative embodiment at 40 psi at a temperature of 105 degrees C. for approximately two minutes. Next, the PC and paper are separated such that the thermoplastic top layer portion of the PC which contains the desired image is separated from the rest of the PC.

Operation of the Test Patch Generator

The test patch generator is comprised of nine shutter modules 210–218 attached to the back (non-image side) of the platen 30. The shutter modules 210–218 may be automatically activated and selectively sequenced by an actuator 220 located at the entrance to station 16. When activated these shutters create a series of latent test patches 222 (labeled Nos. 1–9 in FIG. 5) during the exposure operation. The test patches created during each exposure become visible after toning has occurred. A retractor 224 is located on the exit side of exposure station 16 and will retract the shutter modules 210–218 to their rest position.

Figure 5:
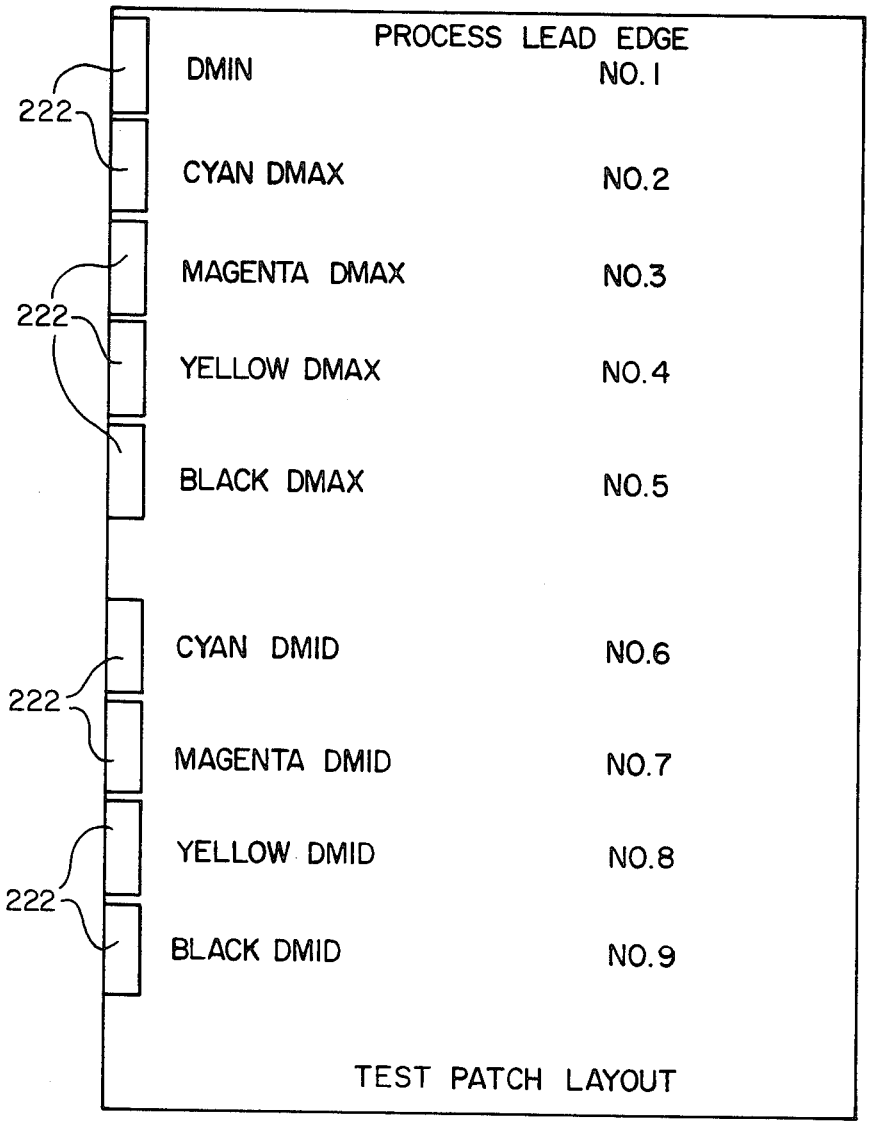
FIG. 5 is a schematic diagram illustrating the location of the test patches on the photoconductive (PC) film along with the corresponding color density and test patch identifier number.
Figure 6:
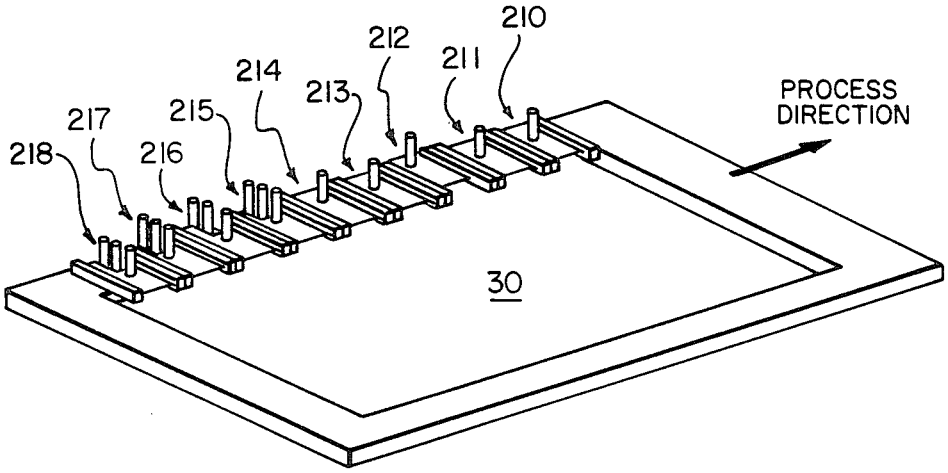
FIG. 6 is a schematic diagram illustrating the location of the shutter modules along the edge of the platen that are used to generate the test patches on the photoconductive film.
Figure 8:
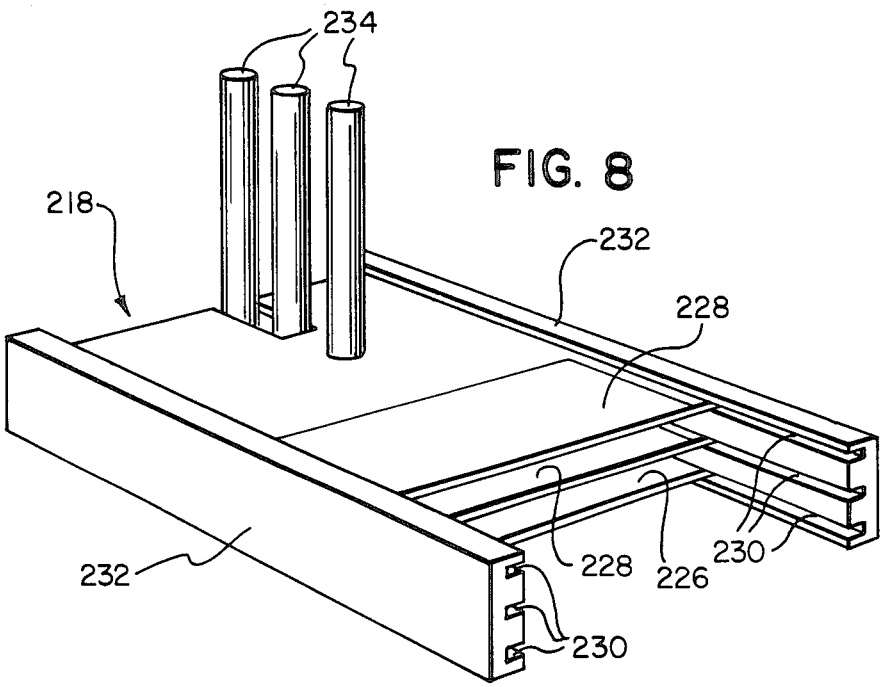
FIG. 8 is an enlarged perspective view of a shutter module having multiple shutter blades and used to generate DMID test patches.
Figure 7:
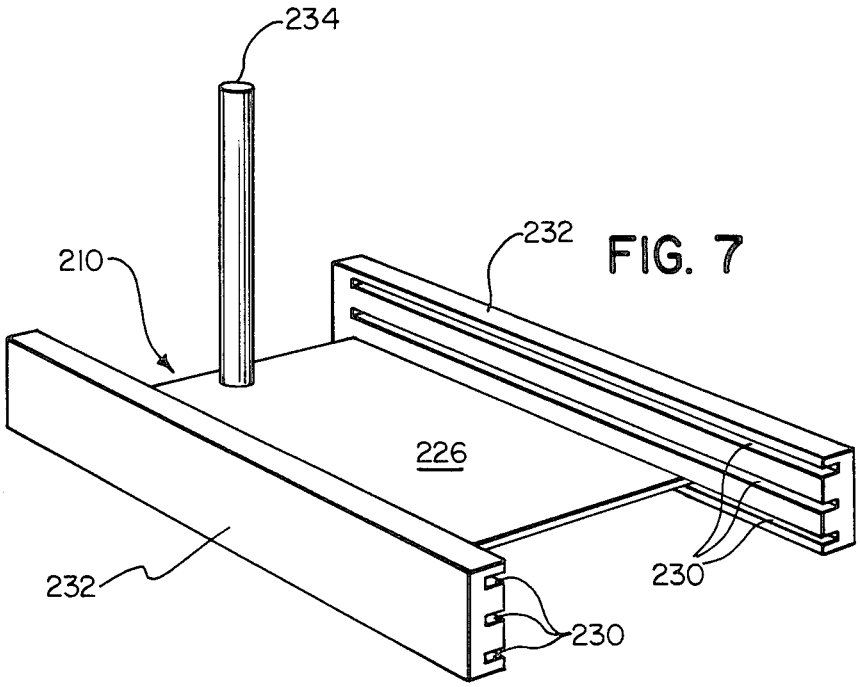
FIG. 7 is an enlarged perspective view of a shutter module having a single dark shutter used to generate DMIN and DMAX test patches.

The test patch generator forms a series of nine 1.25 inch×3.25 inch latent electrostatic images (after four toning cycles) along the edge (non-image area) of the PC (FIG. 5). One minimum density ($D_{min}$) test patch No. 1 is formed on the PC upon actuation of the $C_{min}$ shutter module 210 which has a single movable dark shutter 226, which when moved over the PC forms test patch area No. 1 by blocking exposure of that portion of the PC under the dark shutter 226. Four maximum density (DMAX) test patches No. 2–No. 5 (one for each toned color) are formed on the edge of the PC upon actuation of the DMAX shutter modules 211, 212, 213, and 214. Each shutter module is activated during its respective toning cycle. This results in the formation of four DMAX test patches No. 2–No. 5 for the following colors: cyan, magenta, yellow, and black respectively. Four middle density (DMID) test patches No. 6–No. 9 (one of each toned color) are formed on the edge of the PC upon actuation of the DMID shutter modules 215, 216, 217, and 218. Each shutter module is activated during its respective toning cycle. This results in the formation of four DMID test patches No. 6–No. 9 for the following colors: cyan, magenta, yellow and black respectively (see FIG. 5). There are two types of shutter modules. The first type shutter modules 210–214 as illustrated in FIG. 6 and is used to generate the single DMIN and the four DMAX (No. 2–No. 5) test patches and consist of a single dark shutter 226. The DMIN and DMAX test patches are generated by either totally exposing or totally blocking the radiation coming from the light source respectively. To block exposure, dark shutter 226 is moved over the test patch area preventing the light from reaching the PC. The four remaining modules 215–218 used to generate the DMID test patches (FIG. 6) consist of a three-shutter stack (FIG. 8). The dark shutter 226 is at the bottom of the stack. Two ND shutters 228 each containing a 0.51 ND (neutral density) filter are above the dark shutter. In all cases, the shutters slide within one of three pairs of opposed tracks or grooves 230 formed in the edge members 232 of the shutter modules 210–218. Each shutter has an actuating stem 234 which takes the form of a round post that extends upwardly from the plane of the shutter blade. The actuating stem 234 of the uppermost ND shutter blade 228 is located approximately in the mid-portion of the shutter module 218 (FIG. 8) and rigidly attached to the ND shutter blade 228. The dark shutter blade 226 that is positioned in the lower pair of grooves 230 in the edge blocks 232 has the actuating stem 234 positioned near the mid-portion of the rear edge of the dark shutter 226. The ND shutter blade 228 that is positioned in the middle pair of grooves 230 has its actuating stem located midway between the actuator stem 234 of the top shutter blade and the actuating stem 234 of the lower dark shutter 226. The type of shutter modules 210–214 are used for DMIN and the four DMAX test patches is illustrated in FIG. 7. The type of shutter modules 215–218 that form the four DMID (No. 6–No. 9) test patches is illustrated in FIG. 8.

The actuator 220 for the shutter modules 210–218 consists of an actuating blade 236 attached to a carriage 238 the blade is positioned at an angle of 30 degrees to the direction of motion of platen 30. Three pneumatic solenoids 240, 242 and 244 move the carriage 238 carrying the actuating blade 236 into a predetermined position so that only selected shutter blades will be moved over the PC as the platen 30 moves toward the exposure station 26.

Figure 9:
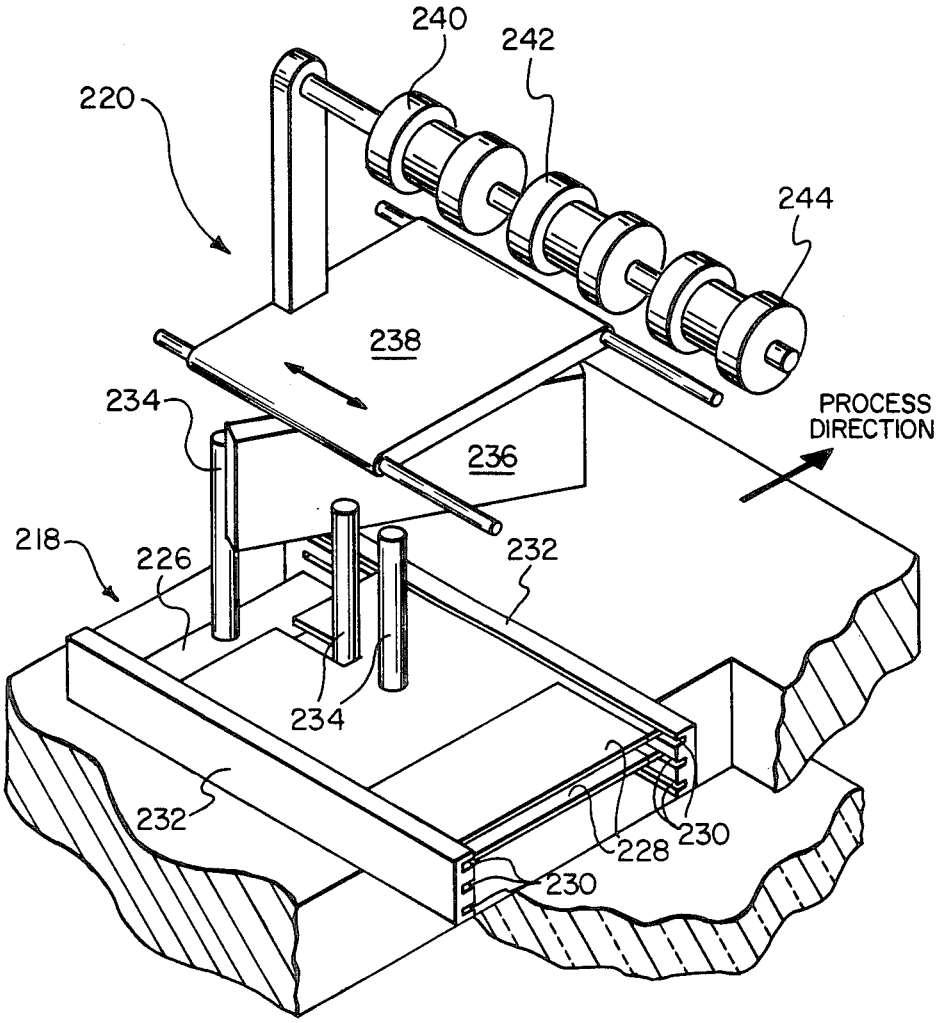
FIG. 9 is an enlarged perspective view of the actuator mechanism according to an embodiment of the invention used to selectively actuate specific shutters in the shutter modules.

Without energizing any of the pneumatic solenoids, all three shutter blades would be moved over the PC as the platen moves toward the exposure station 26 the rear most actuating stem 234 mounted on the lower dark shutter 226 engages the blade 236 moving all three shutters over the PC, thereby blocking exposure from that area of the PC. Energization of pneumatic solenoid 240 moves the blade 236 to the position shown in FIG. 9 so that movement of the platen 30 results in the engagement of the middle actuating stem 234, thereby moving the two upper ND shutters each containing a 0.51 ND over one of the DMID (No. 6–No. 9) test patch areas for the color being toned. Energizing pneumatic solenoids 240 and 242 moves the actuator past the rear two actuating stems 234 so that platen travel results in the actuating stem 234 for the uppermost ND shutter, a 0.51 ND filter, to engage the actuating blade 236 so that only the top most shutter blade is moved over the PC. Energizing all three pneumatic solenoids 240, 242 and 244 moves the actuating blade 236 past the actuating stems of all the shutter blades so that none of the actuating stems 234 engage the actuating blade 236; thus, no shutter blades are moved over the PC, permitting total exposure of the corresponding test patch area.

The DMID (No. 6–No. 9) test patches are formed by exposing the test patch area to a percentage of the radiation from the exposure source. This is done by actuating the desired shutter blade or blades over the test patch area that corresponds to the color being toned.

In the negative/positive mode, the DMID (No. 6–No. 9) test patch areas must be exposed to 31% of the total radiation coming from the light source. This requires the movement of a single ND shutter blade (when only one 0.51 ND filter is required, the upper shutter blade is actuated) containing a 0.51 ND filter is automatically moved over the DMID test patch area which corresponds to the color being toned.

In the positive/negative mode, the DMID test patch areas are exposeed to 10% of the total radiation from the light source. This requires two ND shutter blades (the two uppermost shutter blades are used each containing a 0.51 ND filter) be moved over the test patch area corresponding to the color being toned.

Figure 10:
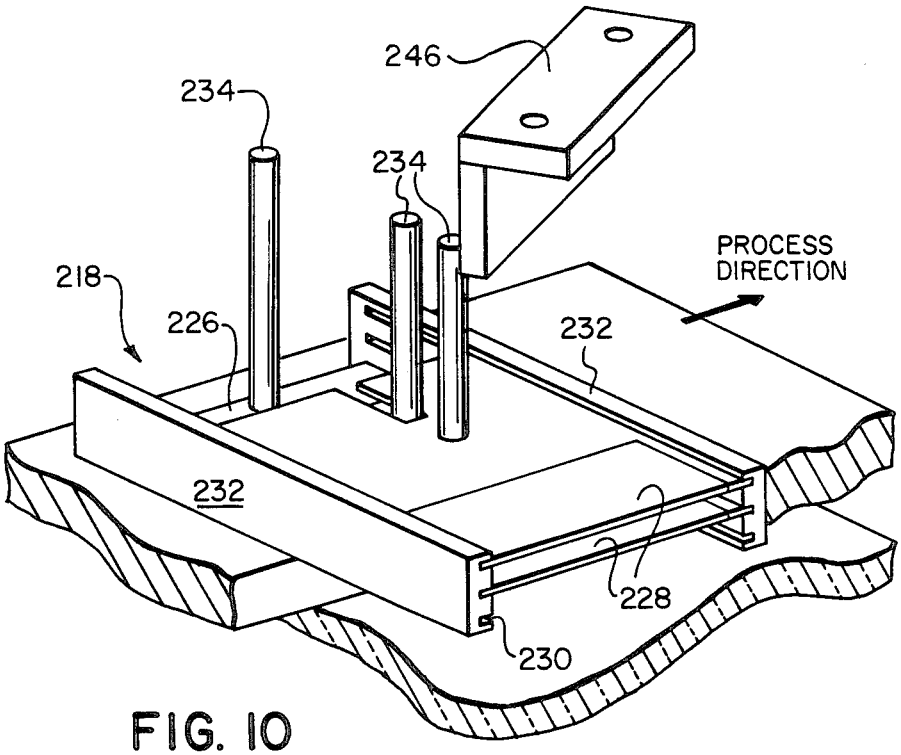
FIG. 10 is an enlarged perspective view of the retractor according to an embodiment of the invention.

A retractor 224 illustrated in FIG. 10 is located on the exit side of exposure station 26. The retractor 224 consists of a permanently mounted blade 246 which is angled 30 degrees in the opposite direction to the actuating blade 236 on carriage 238, so that as the platen 30 exits the exposure station 26 any shutter blades that have been extended over the PC will be retracted when their actuating stems engage the angled retractor blade 246 which is in an interference relationship with any extended shutter blades. Thus the retractor blade 246 will retract any and all shutter blades that had been activated by the actuator 220.

It should be understood that a second fixed blade (not shown) angled in the same direction as the actuator blade 236 may be used proximate the retractor station 224 but located slightly downstream from retractor blade 246 to assure that all shutter blades are in their retracted position when the platen 30 makes it return trip.

During any particular toning cycle, the areas for the test patches of all other colors remain at minimum density. The shutters are sequenced so that DMIN test patches are formed in the locations of the test patches for the colors not being toned. DMIN, DMID, and DMAX test patches are generated for the color presently being toned. Corresponding colors are indicated in FIG. 5 next to the respective test patch areas.

The process parameters of electrostatic voltage and density are sensed from the test patches. The parameters are used by the control electronics 24 to monitor imaging subassemblies and to track film and toner characteristics to provide optimum image density on the photoconductor (PC).

The post-exposure electrostatic voltage is sensed by first electrometer 74 on the latent image of the DMAX test patches No. 2–No. 5 for each of the respective colors. This information is used to set the $V_{Bias}$ on the developer electrode before the toning of that color. The voltage read by electrometer 74 is also an indicator of charging efficiency and when compared to the voltage read by second electrometer 84, is used to determine the voltage decay rate. Electrostatic voltage readings are used to determine film characteristics of speed and minimum, exposure voltage.

The transmission density values of the toned DMID and DMAX test patches as used by densitometer 102 are correlated with the post-exposure electrostatic voltage readings and used by the control electronics 24 to update the characteristic curves of the toner. These curves indicate the relationship between density and voltage of each toner. By knowing the desired density to be deposited on the PC, the control electronics 24 uses these curves to determine at what voltage the PC must be charged and at what bias the toner electrode must be set to produce an optimum image. The density values are updated after each toning cycle; in this way, successive development cycles use the toner curves which have been updated from the previous cycle of the same color toner. Thus, the transmission density of the test patches should be equal to a predetermined aim density for each toned color. Any deviation from that density causes the control electronics 24 to adjust the charger grid voltage $V_{Grid}$ and toner electrode bias $V_{Bias}$ to bring the test patch back to the required aim density.

It is the purpose of the process control algorithm that resides in the control electronics 24 to control the proofing process to achieve the desired aim transmission density on the PC. The slope of the Density/Delta-V curve and the density DMAXNET are used to predict the working delta-V aim (WDVAIM) which governs toning control.

Figure 12:
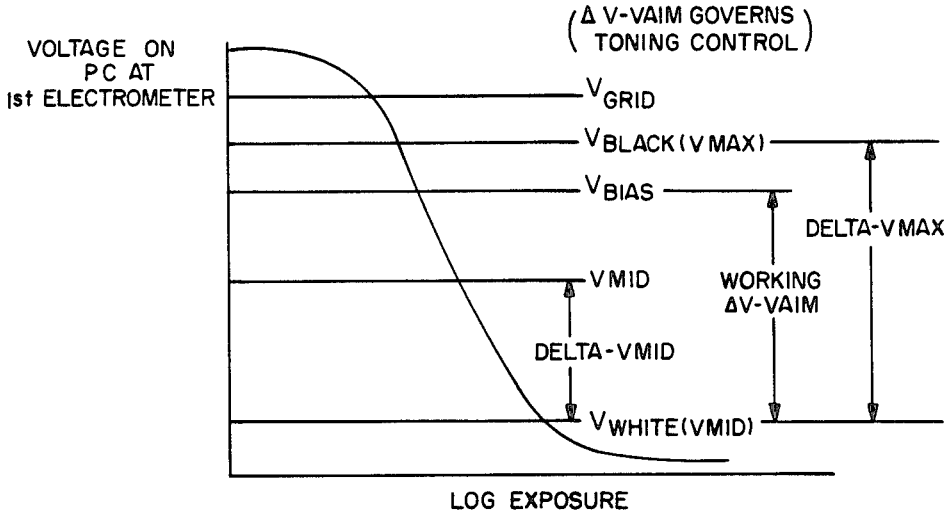
FIG. 12 is a graph of voltage on the PC vs. Exposure (there are two similar curves for each color toner, one for the negative/positive mode and the other for the positive/positive mode)
Figure 11:
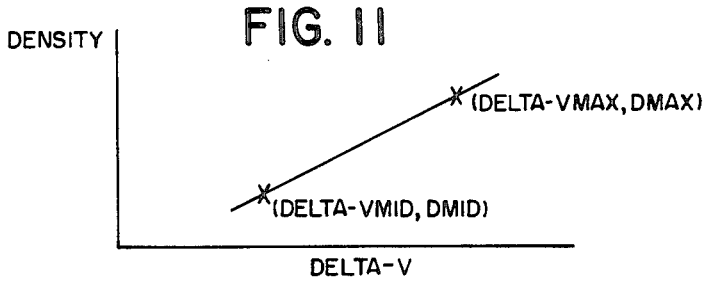
FIG. 11 is a graph of Density vs. Delta-V and illustrates the toner characteristics (there are two similar curves for each color toner, one for the negative/positive mode and the other for the positive/positive mode)

FIG. 11 illustrates two points on the toner characteristic Density/Delta-V curve, determined by points (DMAX, DELTA-VMAX) and (DMID DELTA-VMID). These are two curves similar to that illustrated in FIG. 11 for each toner (one for the negative/positive mode the other for the positive/positive mode). The curve is modified for each pass after the net densities of DMAX and DMID control patches are calculated. The slope of the curve in FIG. 11 and the value of DMAXNET are used to predict the WDVAIM on the curve shown in FIG. 12. (WDVAIM is the determinant parameter controlling the development process). There are also two curves similar to the one shown in FIG. 12 for each toner (one for the negative/positive mode the other for the positive/positive mode). The curve is modified for each pass after the electrostatic voltages VMAX, VMID and VMIN readings on the DMAX, DMID and DMIN test patches respectively, that are read by electrometer 74. The difference between VBIAS and VMIN gives the WDVAIM.

The following two examples are given to illustrate in detail the sequence of events that occur for the cyan toning pass—in Example #1 Negative/Positive Proofing Mode and Example #2, Positive/Positive Proofing Mode.

EXAMPLE #1

Negative/Positive Proofing Mode

A typical developing order is black, cyan, magenta, and yellow.

Cyan Developing Pass

The PC and cyan negative input separation film have been loaded onto the platen 30.

The control electronics 24 calculates the voltage on the grid 54 using the performance of the charger apparatus 46 updated from the previous pass (black toning cycle).

The control electronics 24 calculates an estimated electrode bias (VBIASCALC or $V_{BIASCAL}$) for second development electrode 86 based upon the working delta-V, VBLACK, and the voltage decay data from the previous pass (black developing cycle).

The control electronics 24 selects the cyan negative/-positive mode configuration of test patches for this toning cycle.

The PC is charged.

Before exposure:

The dark shutter for DMIN shutter module 210 is moved over the test patch area No. 1, blocking exposure on the DMIN test patch.

The magenta, yellow, and black dark shutters are moved by shutter modules 212, 213, and 214 over the DMAX test patch areas No. 3, No. 4, and No. 5. The cyan DMAX dark shutter remains in the retracted position.

The cyan DMID shutter with the 0.51 ND filter is moved by shutter module 215 over the cyan DMID test patch area. The magenta, yellow and black DMID dark shutters are moved by shutter modules 216, 217 and 218 over their respective test patch areas No. 7, No. 8 and No. 9; the dark shutters 226 block exposure of the DMID test patch areas No. 7, No. 8 and No. 9 for these three colors.

The image area and test patch area are exposed by source 64 at station 26.

After exposure:

All test patch shutters are retracted by retractor blade 246.

The electrostatic voltages VMAX, VMID and VMIN are sensed on the latent images of the cyan DMAX, DMID, and DMIN patches No. 1, No. 2 and No. 6, respectively, at the first electrostatic voltmeter 74 which is located after the exposure station 26 and prior to the first developing station 80. The control electronics 24 adjusts the bias (VBIASADJ or $V_{BIASADJ}$) on the cyan developing electrodes based upon the voltage on the cyan DMAX test patch No. 2 (VMAX or $V_{Black}$) at electrometer 74 and the estimated voltage decay rate updated from the previous pass (black toning cycle).

The electrostatic voltages VMAX ($V_{Black}$) and VMID ($V_{MID}$) are sensed on the latent image of the cyan DMAX patch No. 2 and the cyan DMID test patch No. 6, respectively, at the second electrostatic voltmeter 84 which is located between the first and second developing stations 80 and 84 respectively. The control electronics 24 makes the final adjustment on the bias (VBIASFINAL) on the cyan developing electrodes based upon the actual voltage decay rate. The control electronics 24 updates the voltage decay rate curve for the cyan negative/positive pass.

The platen 30 enters the cyan developing station. The PC is toned over the cyan toning station.

After toning:

The transmission densities of all control patches are sensed at the transmission densitometer 102.

The control electronics 24 algorithm calculates the net densities of the cyan DMAX and DMID control patches (DMAXNET and DMIDNET) No. 2 and No. 6 respectively. The densities of the cyan DMAX and DMID test patches No. 2 and No. 6 before toning (sensed during the black toning cycle) are subtracted from the densities of the respective patches sensed after the cyan toning cycle.

The densities of the magenta test patches No. 3 and No. 7 (not yet processed) will be used to compute the net densities of these patches after they are processed.

The densities of the DMIN, black and yellow test patches are ignored for the cyan negative/positive toning pass.

The net densities DMAXNET and DMIDNET of the cyan DMAX and DMID test patches No. 2 and No. 6 are correlated with the electrostatic voltages VMAX and VMID, respectively. Based upon this correlation the control electronics updates the cyan developer Density/Delta-V curve (off the type shown in FIG. 11) for the next cyan pass. This curve is used in setting the charger grid voltage, for that particular exposure aperture setting, and the toner electrode bias for the next cyan toning cycle.

EXAMPLE #2

Positive/Positive Proofing Mode

A typical developing order is black, cyan, magenta, and yellow.

Cyan Developing Pass

The PC and cyan positive input separations are loaded onto the platen 30.

The control electronics 24 calculates the voltage on the grid 54 using the performance of the charger apparatus 46 updated from the previous cyan toning cycle.

The control electronics 24 calculates an estimated toner electrode bias (VBIASCALC) based upon the working DELTA-V, VBLACK, and the voltage decay data from yellow toning pass of the previous proof.

The control electronics 24 selects the cyan positive/-positive mode configuration of test patches for this toning cycle.

The PC is charged.

Before exposure:

The dark shutter for DMIN shutter module 210 remains retracted, permitting the DMIN test patch to be exposed.

Only the cyan DMAX dark shutter module 211 is moved over the DMAX test patch area. The magenta, yellow, and black DMAX dark shutters remain retracted.

Two cyan ND shutters 228 each containing a 0.51 ND filter are moved over the test patch area No. 6. All magenta, yellow, and black DMID dark shutters remain retracted.

After exposure, all control test patch shutters are retracted by retracting blade 246.

The electrostatic voltages VMAX, VMID, and VMIN are sensed on the latent images of the cyan DMAX, DMID, and DMIN test patches No. 2, No. 6 and No. 1, respectively, at electrometer 74. The control electronics 24 adjusts the bias (VBIADADJ) on the cyan toning electrodes 86 based upon the voltage on the cyan DMAX test patch area No. 2 (VMAX) at electrometer 74 and the estimated voltage decay rate updated from the yellow toning pass of the previous proof.

The electrostatic voltages VMAX and VMID are sensed on the latent images of the cyan DMAX and DMID test patches No. 2 and No. 6, respectively, at electrometer 74. The process control algorithm computes the actual voltage decay rate by subtracting the VMAX at electrometer 74 from the VMAX at electrometer 84. The control electronics 24 makes the final adjustment on the bias (VBIASFINAL) on the cyan toning electrodes based upon the actual voltage decay rate. The control electronics 24 updates the voltage decay rate curve for the cyan positive/positive pass.

The platen 30 enters the cyan toning station 86. The PC is toned over the cyan toning station 86.

After toning:

The transmission densities of all test patches are sensed at the transmission denitometer 102.

The control electronics 24 calculates the net densities of the cyan DMAX and DMID test patches No. 2 and No. 6 (DMAXNET and DMIDNET). The densities of the cyan DMAX and DMID test patches before toning (sensed during the black toning cycle) are subtracted from the densities of the corresponding test patches sensed after the cyan toning cycle.

The densities of the magenta test patches (not yet toned) will be used to compute the net densities of these test patches after they are toned.

The densities of the DMIN, black, and yellow test patches are ignored for the cyan positive/positive toning pass.

The net density values DMAXNET and DMIDNET of the cyan DMAX and DMID test patches No. 2 and No. 6 are correlated with the electrostatic voltages VMAX and VMID respectively. Based upon this correlation and the control electronics 24 updates the cyan toner Density/Delta-V curve (similar to that illustrated in FIG. 12) for the next cyan pass. This curve is used in setting the voltage on the charger grid 54, for that particular exposure aperture setting, and the toner electrode bias for the next cyan toning cycle. Examples of PCs which can be used with apparatus 10 are described in U.S. patent application Ser. No. 773,528, filed Sept. 6, 1985, now U.S. Pat. No. 4,600,669, which is a continuation-in-part of U.S. patent application Ser. No. 686,509, filed Dec. 12, 1984, now abandoned. Both of these applications have the same assignee as the present application.

A. Overview

Figure 13:
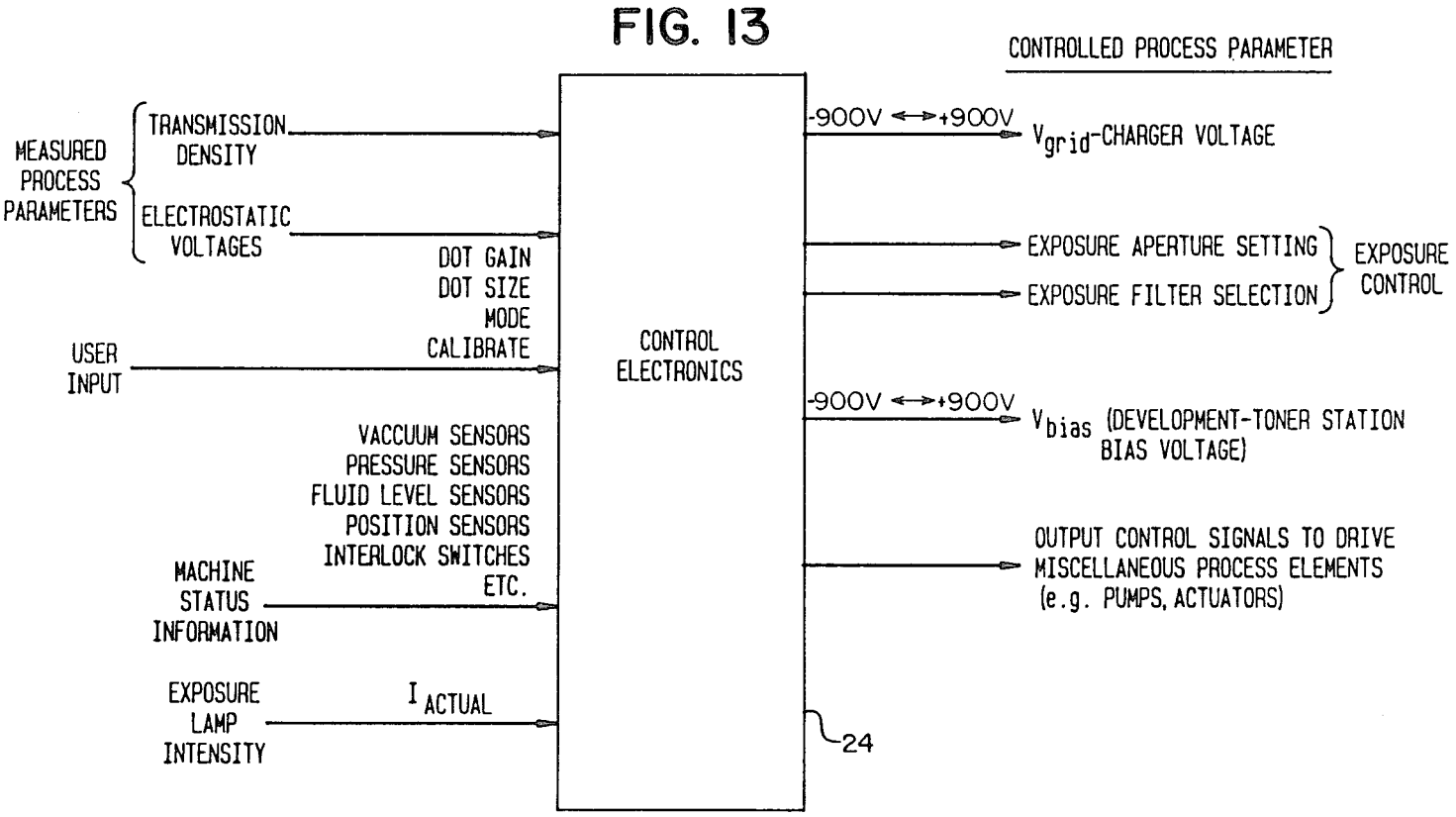
FIG. 13 is a diagram depicting the process controller and principal process input and output signals used in the inventive system.

FIG. 13 is a diagram depicting the process controller and principal process input and output signals used in the inventive system. As noted, the system can operate in two distinct modes: pos/pos mode wherein a positive separation is used to make a positive proof or alternatively in neg/pos mode wherein a negative separation is used to make a positive proof. Generally speaking, only the sign of any process control voltage ($V_{bias}$, $V_{grid}$, and the measured electrostatic film voltages ) changes, for example, from negative to positive, whenever the mode changes, for example, from pos/pos to neg/pos mode. The magnitude of these voltages often remains the same. Completely exposed film test patches will be referred to as white (DMIN) and completely unexposed test patches will be referred to as black (DMAX). To simplify the ensuing discussion, only the neg/pos mode will be specifically discussed. However, specific mention will be made whenever variations other than mere sign changes occur between modes.

As previously discussed, the user supplies the system, through control electronics 24, with four parameters: desired dot size (on an integer scale of 0 to +6), desired density (on an integer scale of −6 to 0 to 6), separation mode (i.e. pos/pos or neg/pos mode), and whether the system is to execute a calibration pass. Then, with this information, control electronics 24 automatically controls dot size and density by appropriately varying three controlled process parameters: the amount of light used to expose the photoconductive film (the "exposure"), the voltage applied to the charger grid (the "grid" voltage or $V_{grid}$) and the bias voltage ($V_{bias}$) applied to the particular development head that is used to tone the image during any toning pass. The magnitude of voltage $V_{grid}$ establishes the amount of charge that is initially placed onto the photoconductive film. The amount of toner to be deposited on the PC film is determined by the magnitude of the difference between the voltage of the areas to be toned on the PC at the start of development and the voltage ($V_{bias}$) applied to the roller electrodes of the development toner station. As discussed, control over $V_{grid}$ and $V_{bias}$ is effectuated by processing measurements of a number of process parameters: the transmission density of the test patches on the toned image, and the electrostatic voltages of exposed portions ($V_{white}$ and $V_{midtone}$) and of an unexposed portion ($V_{black}$) of the film test patches at two specific locations. As noted, these locations are situated directly after the charging station 46 and directly after the yellow development head 80. The densitometer 102 measures the transmission density of each test patch during each toning process.

The control algorithm is implemented as a program which is stored within and executed by the micro-computer system. Analog process inputs include the film voltages, $V_{black}$, $V_{white}$ and $V_{midtone}$, as measured by electrometers 74 and 84, the actual exposure lamp intensity, Iactual, as measured by exposure intensity monitor 60 and the output signals produced by densitometer 102. Digital process inputs include the position of both exposure neutral density shutters, various machine status signals, and user input data (i.e. dot size, density, mode, calibration pass desired) provided through keyboard 308 located on operator control panel 26 (see FIG. 1). The analog process control output signals include the $V_{grid}$ voltage produced by programmable power supply 310 and the $V_{bias}$voltage produced by programmable power supply 312. Certain digital process control output signals are applied from the micro-processor system, through stepper motor controller 314 and relays 316, to operate exposure control actuators 318 to provide the desired exposure setting. Other digital process output signals are applied through solenoid valves 454 to operate test patch neutral density shutter 228 and dark shutters 226. Lastly, still other digital output process signals are used to activate corona high voltage supply 324; are applied through densitometer lamp driver 326, to activate densitometer lamp 328; and are applied through miscellaneous relays and solenoids 330 to actuate various system components (e.g. pumps, solenoids, and the like) to ensure proper system sequencing.

In particular, micro-computer system 332 is implemented using a standard 16-bit micro-processor chip 334, illustratively a Model 80186 Micro-processor manufactured by the Intel Corporation. The micro-processor itself and its supporting circuitry are all inter-connected through standard system bus 336.

The supporting circuitry initially includes random access memory (RAM) 338, read only memory (ROM) 340, interrupt controller 342, keyboard controller 344, and cathode ray tube (CRT) controller 346. ROM 340 stores the control program which includes executable code as well as various tables of constants. By contrast, RAM 338 stores measurement data and updated table values. Because any loss of this measurement data would be detrimental to proper system operation, RAM 338 is connected to battery backup circuit 348 which, in the event of a power failure, preserves the contents of the RAM using battery 350. Interrupt controller 342 monitors various conditions occurring within the micro-processor system itself, e.g. requests for input/output transfers, or conditions occurring within the entire system, e.g. a power-up or the expiration of time interval governed by an external system timer—such as a watchdog timer (not shown but well-known)—and in response thereto causes the micro-processor to interrupt its normal program execution to appropriately respond to these conditions. The interrupt controller assures that all interrupt requests are expeditiously handled but nonetheless prioritizes interrupt requests such that the highest priority interrupt is attended to first. User input (desired dot size, density, mode and calibration pass desired) is provided through keyboard 308. The output of the keyboard, illustratively eight bit parallel, is routed via leads 352 to keyboard controller 344. Keyboard controller 344 is periodically polled by microprocessor 334 to determine if there is any recent user input. If this input exists, keyboard controller 344 applies it, at the appropriate interval, to bus 336 which, in turn, routes it to micro-processor 334 for processing. Output information is provided to the user through display 28, which is illustratively a CRT display. At the appropriate times determined by the program stored within ROM 340, CRT controller 346 accepts data from system bus 336 and converts it into raster scan format for display on display 28. Such a bus based micro-processor system is well-known in the art and is commercially available from many sources, e.g. the MDS system produced by the Intel Corporation.

In addition, micro-processor system 332 contains suitable conversion circuitry to allow it to interface to the controlled system. For example, analog input interface circuits 354 and 420 contain suitable multiplexed analog/digital (A/D) converters which, under control of the program stored within ROM 340, sample and digitize each measured analog process signal (film voltages, actual exposure lamp intensity value and densitometer readings) and apply the resulting digital value through busses 358 and 360 to system bus 336 for subsequent processing by the micro-computer system. Analog output interface circuit 362, connected to bus 364, accepts digital data, under program control via bus 364, from the micro-computer system and converts that data using suitable digital/analog (D/A) converters to analog form. Each analog output is a scaled ±10 volt signal. As shown, one such scaled signal is applied as input to programmable power supply 310 to produce $V_{grid}$, with the input voltage range of ±9 volts corresponding to an output grid voltage range of ±900 volts. The other scaled analog signal is applied as input to programmable power supply 312 to produce $V_{bias}$, with the input voltage range of ±9 volts corresponding to an output bias voltage range of ±900 volts.

Digital input/output to the micro-processor system is provided through digital input interface circuit 366 and digital output interface circuit 368, which are respectively connected through busses 360 and 370 to system bus 336. As instructed by the program stored within ROM 715, digital input interface circuit 366 latches the status of various digital input signals and provides the micro-processor system with this input information for subsequent processing. Also the micro-computer system, as determined by the control program, applies data over bus 370 to digital output interface circuit 368 which, in turn, sets any digital output bit to a desired state in order to control a driver and thereby effectuate a desired system function (open the exposure aperture, move a neutral density shutter 228 into position, turn off the corona supply, start a pump and the like).

Now, with this overall architecture in mind, the discussion will now address the specific input/output process connections between the proofing system and micro-processor system 332.

As noted, film voltages $V_{black}$, $V_{white}$, and $V_{midtone}$ occurring at each of two locations, are measured by electrostatic voltmeters 372 which includes electrostatic voltmeter 74 and electrostatic voltmeter 84. Electrostatic voltmeter 74 produces voltage measurements $V_{black1}$, $V_{white1}$ and $V_{midtone1}$: while electrostatic voltmeter 84 produces voltage measurements $V_{black2}$, $V_{white2}$ and $V_{midtone2}$. These measured voltages are applied through leads 374 to appropriate inputs, AIN1 and AIN2, of A/D 376 located within analog input interface circuit 354. As noted, exposure lamp intensity monitor 60 (see FIG. 1) is located in the plenum and situated immediately below the lamp housing, and is used to measure the actual output of exposure lamp 64. This output can vary due, for example, to drift in the output of the lamp itself, changes in humidity, or dust accumulating on the mirrors located within the lamp house. In any event, photocell 378, located within the lamp intensity monitor, produces a voltage proportional to the intensity of the light produced by the exposure lamp 64. This voltage is applied to amplifier 380 which appropriately amplifies and scales this voltage to that required as input by A/D converter 376. This scaled voltage, corresponding to Iactual, is applied over lead 382 to another analog input, AIN3, to A/D 376. As shown A/D 376 contains a single A/D converter which is multiplexed between its input analog signals. In response to suitable instructions (including appropriate address information) appearing on bus 358 and emanating from micro-processor system 332, bus interface and A/D select circuit 384 generate suitable control signals to A/D 376. For example, circuit 384 applies suitable signals over lead 386 to select the desired input analog signal that is to be converted. Once this has occurred, circuit 384 applies a suitable signal to lead 388 to initiate an analog-to-digital conversion. Once the conversion has been completed, the digital results (digital output—D/O) are applied to parallel over leads 390 to circuit 384 which, in turn, supplies these results, with a suitable interrupt signal over bus 358, to micro-processor system 332.

Digital transducers 392 provide digital information regarding the position of both exposure neutral density shutters and various status information. In particular, two switches 632 are used to detect the position of each exposure filter. These switches include a "home" switch which detects whether the filter is in its "home" position, i.e. in the light path, and an "end of travel" switch which detects whether the filter is out of the light path. The output of these switches are applied to suitable inputs, DIN, of input interface circuit 496. This circuit interprets a closed switch condition as one digital state (e.g. a logical "1") and an open switch condition as the other digital state (e.g. a logical "0"). The outputs of other digital transducers, collectively referred to as miscellaneous digital inputs 398, are applied to corresponding inputs of input interface circuit 396. Digital inputs 398 include digital signals produced by an optical position transducer which is physically connected to the exposure aperture and which produces a signal when the shutter has reached either its fully open or fully closed position. Inputs 634 also include digital signals produced by various limit switches which are located throughout the proofing system and are used, for example, to detect excessive pressures, travel limits, vaccuum losses, interlock violations, low fluid levels and the like. To obtain digital input data, micro-processor system 332 applies a suitable instruction (including necessary address information) to bus 360. Upon receipt of this instruction, bus interface 400 applies suitable address signals, over leads 402, to select the desired digital inputs. Thereafter, bus interface 400 applies a strobe pulse, over lead 401, to input interface circuit 396. This pulse causes the input interface circuit to latch the digital input data for the particular addressed digital input(s) and then applying the resulting digital data (D/O), over leads 404, to bus interface 400 which, in turn, applies this digital information to the micro-processor, via bus 360, for subsequent processing.

Transmission density, Dtrans, is determined using three color densitometer 102 situated after black toning station 94 (see FIG. 1). This densitometer includes three separate photodetectors, each of which detects the transmission density for a particular color of the toned image, i.e. cyan, magenta, and yellow. Specifically, to detect transmission density, micro-computer system 332 energizes densitometer lamp 328 by applying a suitable digital output signal to densitometer lamp driver 326, via digital output interface circuit 368 —which will be discussed shortly—and lead 410. The densitometer lamp is situated slightly above the film path and shines light through the film to densitometer 102 situated immediately below. In operation, densitometer lamp 328 is energized by the micro-computer shortly after power up and is left on continuously thereafter during machine operation to stabilize the operating characteristics of the lamp. Once the test patch is in proper position, the micro-computer selects one of photo-detectors 412, 414 or 416 to measure the light transmitted through the test patch 222. Specifically, if the test patch has been toned with black or magenta, green photodetector 414 is selected; alternatively, if the test patch has been toned with cyan or yellow, then red photodetector 412 or blue photodetector 416 is selected, respectively. The output voltages produced by each photo-detector are then amplified and appropriately scaled by amplifier 413 for photo-detector 412, amplifier 415 for photo-detector 414 and amplifier 417 for photo-detector 416. The scaled outputs from these three amplifiers are routed over leads 418 to respective analog inputs of analog interface circuit 420 for subsequent digitization as instructed by micro-computer system 332.

On the output side from micro-computer system 332, analog output interface circuit 362 provides two scaled ±10 volt analog output voltages, one of which is applied as input to programmable power supply 310 which produces $V_{grid}$ and the other is provided as input to programmable power supply 312 which produces $V_{bias}$. Analog output interface circuit 362 contains D/A circuit 422, which contains a number of separate D/A converters. Upon receipt of an appropriate instruction (with suitable accompanying address information) over bus 364 from micro-computer system 332, bus interface and D/A select circuit 424 applies appropriate signals to leads 426 to select the appropriate D/A converter. Thereafter, digital data is applied via leads 428 to the selected D/A converter followed by a strobe signal over lead 430 to latch this data into the input register of the selected converter. The converter then performs a digital-to-analog conversion and applies the resulting +10 volt scaled analog signal to the appropriate analog output, AOUT. Specifically, analog output signals AOUT1 and AOUT2 provide the control voltage for $V_{grid}$ programmable power supply 310 and $V_{bias}$ programmable power supply 312, respectively. The high voltage produced by supply 312, via output $V_{01}$, is routed through high voltage switching relays 432 which, in response to a suitable select signal applied as input thereto, routes the $V_{bias}$ voltage to the roller electrodes at a desired one of the four development-toner stations depending upon which color will be currently toned onto the film. Relays 432 have four separate high voltage outputs, $V_{01}$, $V_{02}$, $V_{03}$ and $V_{04}$ which are connected to yellow roller electrodes 434 located within development-toner station 80 (see FIG. 1), magenta roller electrodes 436 located within development-toner station 86, cyan roller electrodes 438 located within development-toner station 90 and black roller electrodes 440 located within development-toner station 94, respectively. The select signals applied to relays 432, via leads 442, are produced by digital output interface circuit 368 in response to suitable output data from micro-computer system 332.

In addition, programmable supply 31 provides a second output voltage, typically 1000 volts, which is applied, via output $V_{02}$, to relays 432. Micro-computer system 332 applies a select signal via leads 442 to relays 432 to apply this high voltage as output voltage $V_{05}$ to rinse heads 98 and 104 (see FIG. 1) as the platen passes over the rinse heads in order to clean the film, as previously described herein. Micro-computer 332 turns this high voltage on by applying a suitable digital output as input to supply 312. Furthermore, relays 432, as instructed by the micro-computer system, applies voltage $V_{bias}$, as output voltage $V_{06}$ to the rinse skives also to clean the film, as discussed above.

As noted, digital output interface circuit 368 produces digital output signals which are, in turn, applied through suitable relays, solenoids and controllers to actuate various system functions. Specifically, in response to a suitable instruction (with accompanying address and data information) appearing over bus 370 from micro-computer system 332, bus interface 444 applies the data over leads 446 and thereafter selects the appropriate digital output driver(s) by applying suitable signals to leads 446. Thereafter, bus interface 444 applies a signal over lead 448 to strobe the data into the input of the selected drivers within digital output drivers 450. The digital outputs (DO) of these drivers immediately change state to match the applied data.

Exposure control is effectuated through exposure control actuators 318. These actuators comprise three separate motors **318*a*, 318*b* and 318*c*. Motor 318*a* is a stepper motor that has a shaft that incrementally rotates in one direction or another depending upon the sequence of 24 volt pulses produced by stepper motor controller 314. The shaft is attached through a linkage, as previously described, to shutter 56 (see FIGS. 1 and 3) which opens and closes the exposure aperture. Each incremental movement of the shutter is produced through the voltages appearing at two separate digital outputs from drivers 450 and applied through leads 311 to stepper motor controller 314. Motors 318*b* and 318*c*, which are also bi-directional, appropriately position both exposure neutral density shutters either fully in or fully out of the light path of exposure lamp 64, as required by the control program. These two motors are driven by appropriate output bits produced by drivers 450 and applied over leads 317 to relays 316**.

During the toning process and as required by the control program, either one or both of two ND shutters 228 and/or a dark shutter 226 is appropriately moved into a desired position, i.e. between the film (PC) and the exposure source 64, by shutter module illustrated in FIG. 8, controlled by two pneumatic cylinders 240 and 242. These cylinders are controlled by electrically actuated pneumatic valves 454. These valves are activated by appropriate digital signals appearings over leads 456 from digital output drivers 450 and originating as digital output data within micro-computer system 332.

A separate digital output bit from digital output drivers 450 is used to programmably activate high voltage supply 324. This supply provides an approximately 6000 volt, current controlled 600 Hz waveform that is applied to both corona electrodes 50 and 52 located in each of the six U-channels situated in charging apparatus 46 (see FIG. 2). This voltage is sufficient to ionize surrounding air and thereby generate a field of charged particles, all as previously discussed. In a similar fashion, other digital output bits from drivers 450 are applied over leads 458, through relays and solenoids 360, to sequentially activate a variety of system components, such as pumps, motors, valves and the like in order to ensure proper sequential operation of the entire proofing system.

Whenever power is applied to the proofing system through power switch 462, exposure lamp 64 is on. Continuous lamp operation advantageously stabilizes the operating characteristics of the lamp and lengthens its service life.

In essence, as noted above, the control program, and particularly the algorithm used therein, relies on modelling each of four electro-photographic processes that occur within the inventive system: charging, exposure, film voltage decay and developing. To yield highly accurate performance, the control algorithm has two basic phases: calibration and toning. During the calibration phase, no toning occurs. However, the system obtains initial film voltage measurements and estimates certain parameters indicative of the performance of the charging, exposure and decay processes. The calibration phase—which consists of only one pass during which no toning occurs—produces a set of parameter values for use during the subsequent toning phases(s). The calibration phase must be run at least once before the toning phase begins in order for the system to establish a set of valid initial conditions. Now, once the calibration phase is completed, the toning phase can begin. During each subsequent toning pass, the micro-computer system first uses the models to predict the performance of the actual electro-photographic processes that will subsequently occur in the proofing system and then produces values of the controlled process parameters (the voltages $V_{grid}$ and $V_{bias}$, and the exposure settings) using user input and updated values from a previous pass in order to correctly set the actual control parameters to be applied to the charger, exposure and development-toner stations. Thereafter, actual process data (transmission densities and film voltages under conditions of varying exposure) occurring during that pass are measured. Finally, the measured process data are used by the micro-computer system to update all its process parameter estimates for use during subsequent passes. The performance prediction/parameter estimation and updating processes are repeated during each subsequent toning pass.

Calibration Pass Routine

In calibration passes, the nine test patches are given four levels of exposure; three are unexposed, two are exposed with no ND shutters 228 filters interposed between the test patch and the exposure lamp, two with a single ND shutter 228 interposed and two with both ND shutters 228 interposed. The exposures delivered to the six exposed areas are chosen to obtain good estimates of the model parameters. Measured voltage values of corresponding patches are averaged together and then three A values are calculated by forming the ratios of the exposed voltages to the unexposed voltage. These three measured values are then fit in a least squares sense by the aforementioned nonlinear least squares algorithm, producing the parameter and parameter covariance estimates.

There are six different cases of calculations performed by block 526 (FIG. 18*b*), depending upon mode, pass and type of pass from which data is taken. For the first case, toning passes of neg/pos mode or toning passes after the first pass of pos/pos mode, the decay measurement used above is the average of the three voltage differences from electrometer 74 to electrometer 84 of the white, midtone and black tests patches. If the toning pass is the first pass in pos/pos mode, the algorithm is executed twice to estimate the different slope and intercept parameters, S and f, (where S and f are the slope and intercept points of the linear $V_{decay}/V_{black}$ (i.e. $V_{decay}=SV_{black}+f$) used for decays on unexposed and exposed areas separately. In these two cases, the two decays measured on exposed (white and midtone) test patches are averaged and the measured decay on the unexposed test patch is processed as is.

Figure 15:
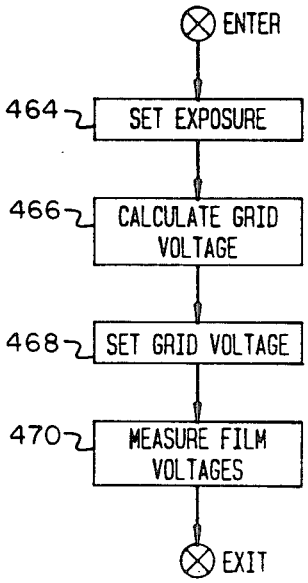
FIG. 15 is a flowchart of the Calibration Pass Routine.

FIG. 15 depicts a flowchart of Calibration Pass Routine.

Figure 17:
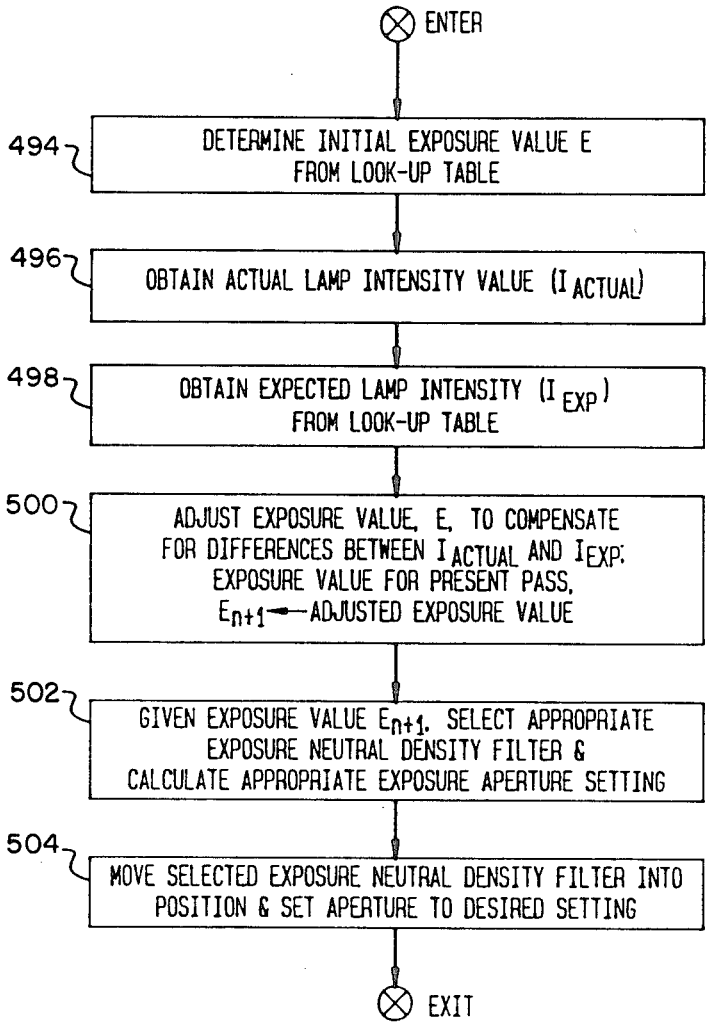
FIG. 17 is a flowchart of the Set Exposure Routine.

Upon entry into this routine, control passes to block 464. This block, explained in detail below in conjunction with FIG. 17, provides exposure control. In particular, during the course of executing this block, the micro-computer system determines the appropriate exposure value for the calibration pass. Once the value is determined, the micro-computer selects the appropriate exposure neutral density shutter to use, if any, and determines the proper aperture opening. Thereafter, the micro-computer sends appropriate control signals to neutral density shutter actuators 418b and 418c (see FIG. 14E) to slide the proper filter(s) into place. Simultaneously therewith, the micro-computer also adjusts the aperture opening by applying direction information and the necessary amount of pulses to stepper motor controller 314 (also see FIG. 14) to appropriately move the shutter 56.

Once the appropriate exposure has been set, then control passes to block 466. Execution of this block produces a calculated value for grid voltage, $V_{grid}$. Once this value has been calculated, it is scaled to a value between ±10 volts. The micro-computer system then instructs analog output interface circuit 362 (see FIG. 14) to apply an analog voltage equivalent to this scaled voltage to the control input ($V_{in}$) of programmable power supply 310. By doing so, the voltage present on the charging grid is set to the calculated value $V_{grid}$.

Figure 14B:
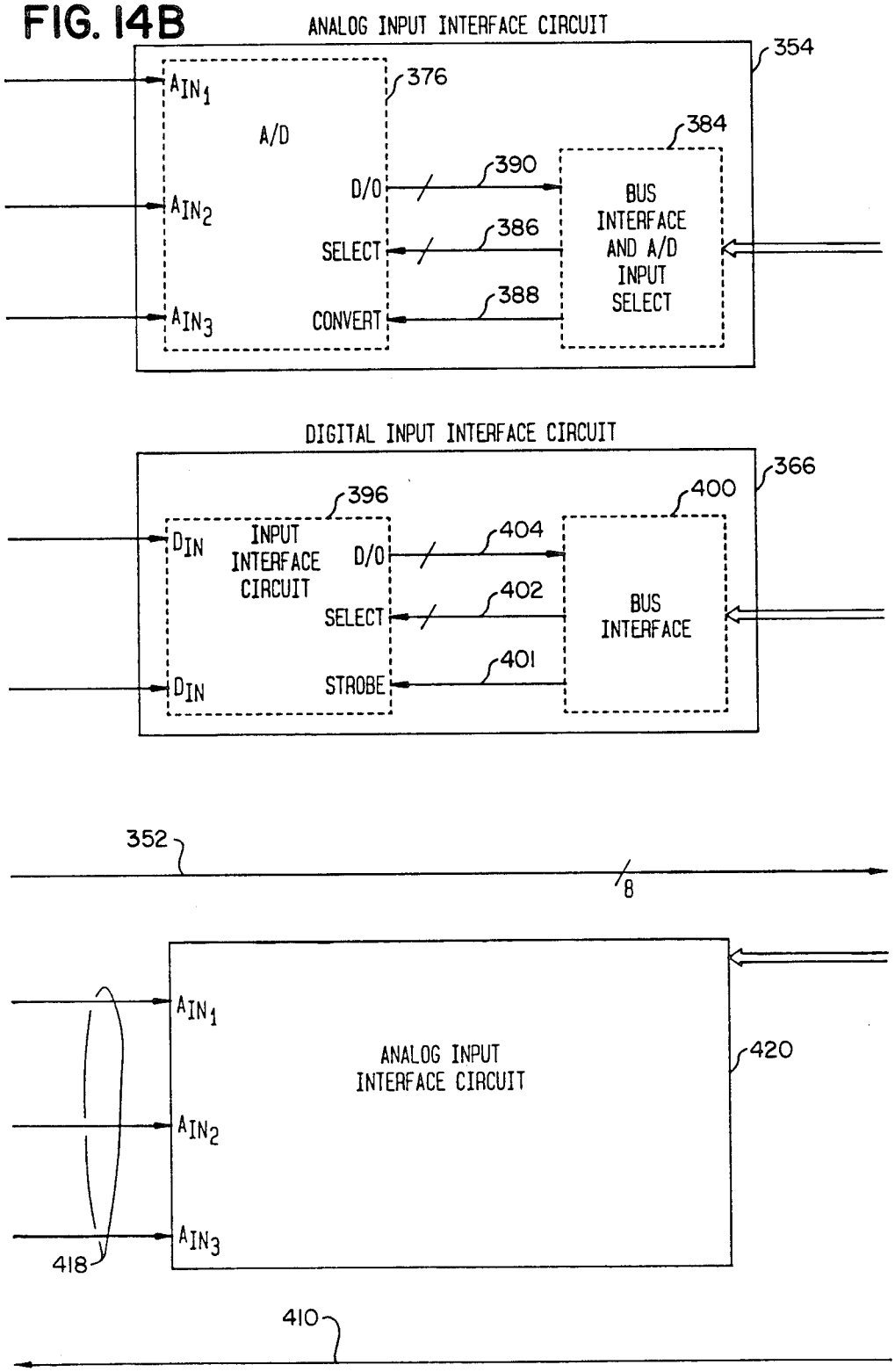
Figure 14C:
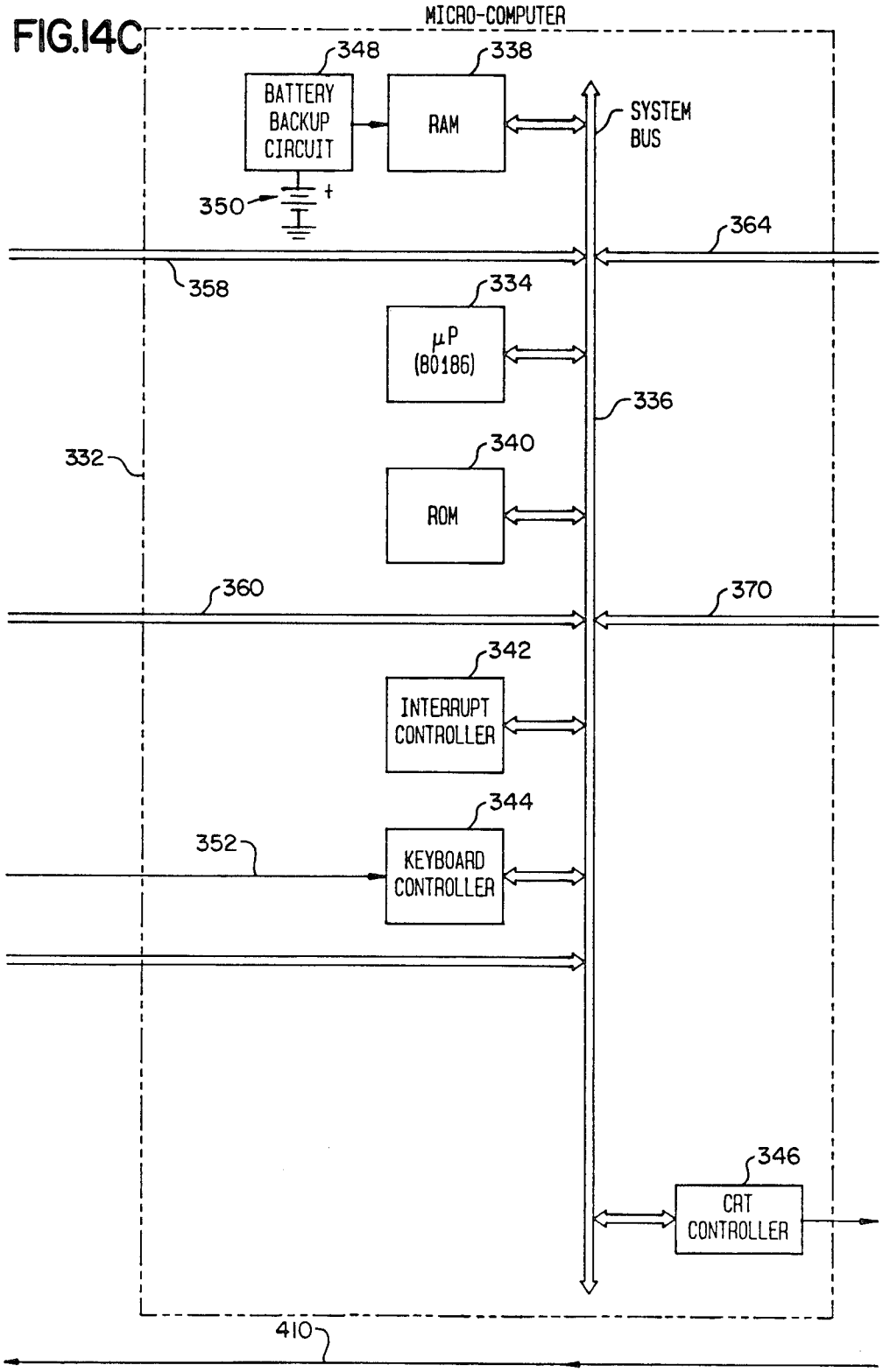
Figure 14D:
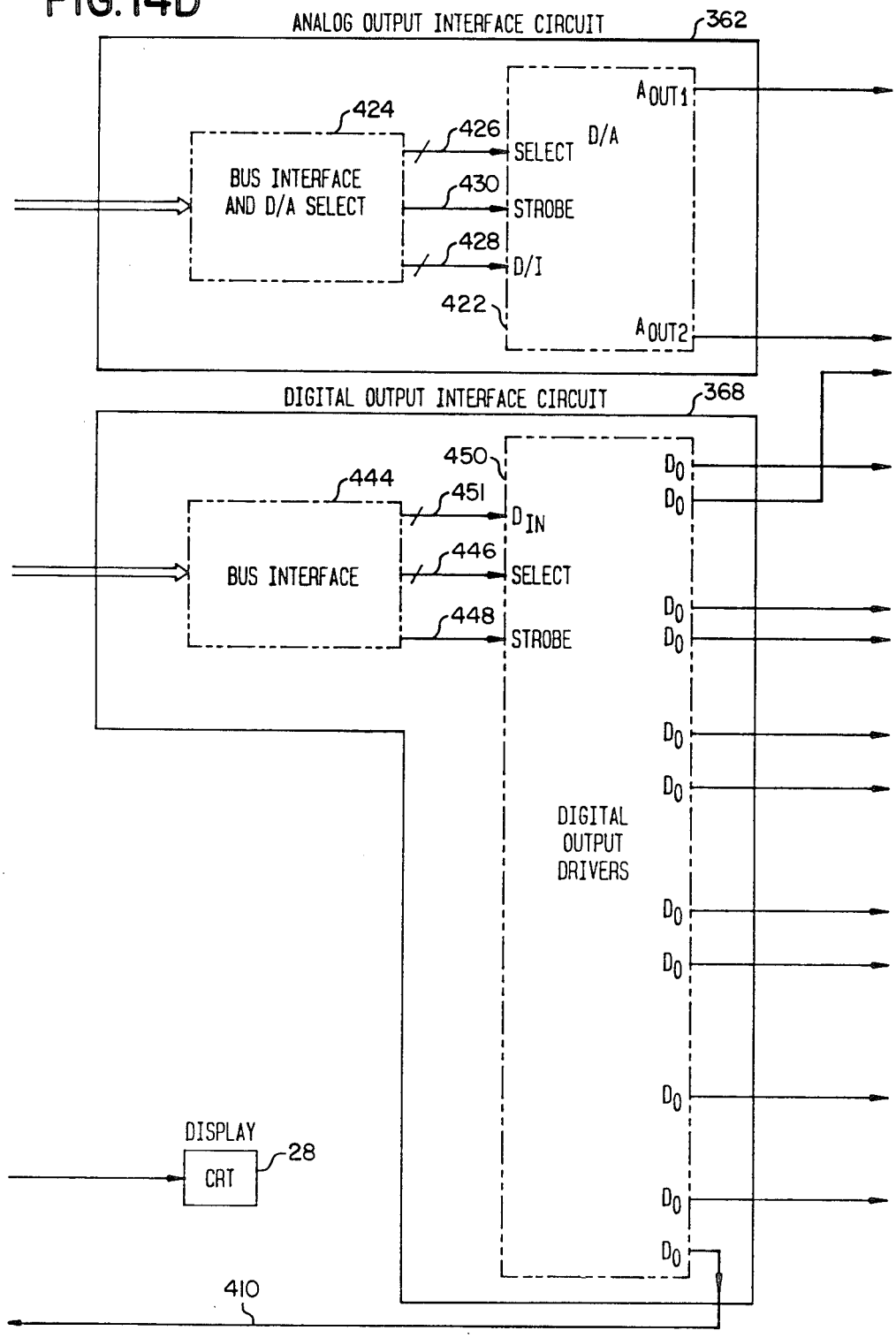

Once the grid voltage has been set, control passes to block 470 which measures the film voltages on the test patches using the electrostatic voltmeter located at the discharge path of the exposure station, i.e. electrostatic voltmeter 74, and the electrometer located just beyond the yellow toning station, i.e. electrometer 84 (see FIG. 14). As soon as these measurements have been taken, control exits from this routine.

Figure 16:
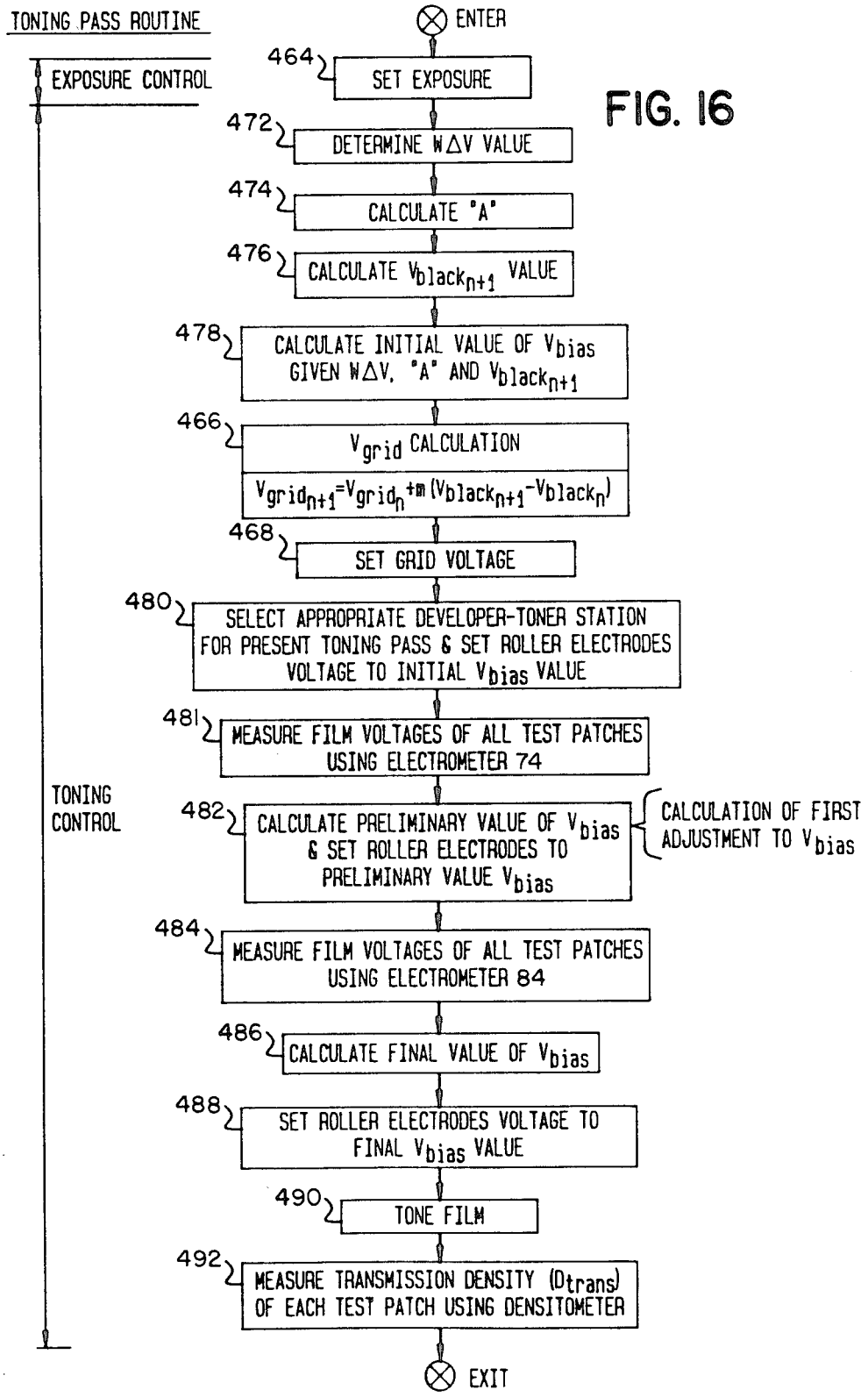
FIG. 16 is a flowchart of the Toning Pass Routine.

FIG. 16 depicts a flowchart of Toning Pass Routine.

Upon entry into this routine, control is first transferred to block 464 which determines the appropriate exposure value for the mode, and then sets the aperture opening and selects the appropriate exposure neutral density shutters, all as described above.

Thereafter, toning control occurs. At this point, block 472 is first executed by micro-computer system 332 (see FIG. 14) to yield a desired value of working voltage at the development station, referred to as WΔV. The actual value of WΔV is the actual voltage difference that is responsible for placing toner onto the photo-conductive film at any particular toning station. Physically, this voltage is the difference between the voltage existing at the development head, $V_{bias}$, less the voltage existing on the areas of the film to be toned. As described in detail below, the desired WΔV value for the color being toned during the present proof (proof n+1) is dictated primarily by the density chosen by the user and the WΔV value used and the density obtained for that same color during the last proof (proof n). With a value for WΔV calculated, control then passes to block 474, wherein the exposure value is used to predict the voltage ratio $V_{white}/V_{black}$, which will hereinafter be referred to as value "A". Subsequently, the desired value of $V_{black}$ for the current pass, $V_{black\ (calc)}$, is calculated in block 1120. Once $V_{black}$ has been calculated and stored, control then passes to block 478 to calculate an initial value of $V_{bias}$ given the values of WΔV, A and $V_{black(calc)}$.

Control then passes to block 466 wherein the value of grid voltage, $V_{grid}$, is calculated. Thereafter, execution passes to block 468 which sets the actual voltage on the grid to the calculated $V_{grid}$ value, as described above.

At the conclusion of these steps, micro-computer system 332 (see FIG. 14) executes block 480 and, in response thereto, applies appropriate digital signals, via digital output interface circuit 368, to select the appropriate development-toner station for the particular toning pass that is to be run. Thereafter, in a similar manner to that executed for the grid voltage, the micro-computer system instructs analog output interface circuit 362 to apply a scaled analog voltage to the control input ($V_{in}$) of programmable power supply 312. By doing so, the high voltage, which is provided as input to high voltage switching relays 432 and from there to the roller electrodes of the selected development-toner station, is the initial value of $V_{bias}$.

At this time, the voltages of all test patches are read using electrostatic voltmeter 74 under control of execution block 480. The initial $V_{bias}$ value is adjusted by block 482 to compensate for effect of prediction errors in the equation used to calculate the initial $V_{bias}$, set forth in detail below, to yield a preliminary value of $V_{bias}$.

Once this has occured, micro-computer system 332 proceeds except in yellow toning passes, via execution of block 484, to obtain measurements of the unexposed ($V_{min}$), exposed ($V_{max}$) and midtone ($V_{mid}$) test patch film voltages using electrostatic voltmeter 84 positioned after the yellow development-toner station (see FIG. 14). Thereafter, the bias voltage calculation is repeated using both these film voltage measurements and the preliminary $V_{bias}$ value. This results in a final value of $V_{bias}$. Since by this time, the platen has not reached the selected development head, the bias voltage produced by programmable voltage supply 312 is adjusted, by execution of block 488, to equal the final $V_{bias}$ value. Thereafter, execution block 490 is executed which activates various mechanical system components at the selected development-toner station, such as air knives and toner pumps so that the film can be toned. While the film is being toned at the selected development-toner station, block 492 is also executed in order to obtain a measurement of the transmission density (Dtrans) of each test patch on the toned film. These measurements will be used in updating the data tables. Once all the transmission densities have been measured, control exits from this routine.

Set Exposure Routine

FIG. 17 depicts a flowchart of Set Exposure Routine 464, shown in FIG. 15. This routine provides exposure control.

Upon entry into this routine, control passes to block 494. Here, micro-computer system 332 (see FIG. 14) accesses a data table to determine an appropriate exposure value ("E"). In a calibration pass, the appropriate exposure value, E, is determined by the user selected mode.

Alternatively, if the present pass is a toning pass, the exposure is determined by the user selected dot size, mode and color for the present toning pass. Once this value has been obtained, control passes to block 496 which, when executed, obtains a value, via analog input interface circuit 354, from exposure lamp intensity monitor 60 indicative of the actual intensity (Iactual) of exposure lamp 60 (see FIG. 14). The micro-computer system then executes block 498 to access a look-up table of constants to obtain the expected value (Iexp) of the light intensity produced by the exposure lamp.

Now with these values determined, execution passes to block 500. Here, the micro-computer compares the two intensity values and then adjusts the exposure value, E, to arrive at the adjusted exposure En+1 to compensate for any differences occurring between the actual exposure lamp intensity value, Iactual, and the expected lamp intensity value, Iexp.

At this point, block 502 is executed to select the appropriate exposure neutral density filter(s) and to calculate the proper exposure aperture size to provide the exposure value En+1. Once this has been accomplished, execution passes to block 504. Here, micro-computer 332 applies suitable digital signals, via digital output interface circuit 368 and through relays 316, to motor **418*b* and/or motor 418*c* to move the filter(s) into their proper position within the lamp houjsing (see FIG. 14). In addition, the micro-computer produces a sequence of digital pulses over leads 311 to cause stepper motor 418*a* to appropriately vary the shutter size. In particular, these pulses are applied, via digital output interface circuit 368 and leads 311, to stepper motor controller 314 to cause stepper motor 418*a*** to incrementally move the shutter to bring the exposure aperture to the appropriate opening. Once the exposure has been properly set, execution exits from this routine.

Electro-photographic Process Models

As noted previously, the control process used in the inventive system utilizes four empirically derived mathematical models to describe the physical electrophotographic processes that actually occur in the inventive proofing system, namely; a charger model, an exposure model, a decay model and a developer model. These models are updated at the end of every pass using measurement data obtained during that pass. In particular, the charger, exposure and decay models are updated at the end of the calibration pass and all the models are updated at the end of every toning pass. At the beginning of each subsequent toning pass for the current proof, the exposure that will be used is determined as previously described and the models are inverted to yield accurate values for all the control parameters $V_{grid}$ and $V_{bias}$ in order to yield maximum system performance. As noted, the initial values used in these models are obtained from the calibration pass. A calibration pass is executed whenever the user changes the input data (i.e. dot size, density or mode), whenever the user instructs the proofing system to execute a calibration pass, or alternatively whenever the system is first powered-up. Calibration calculations use both parameter values obtained from data tables and actual measurements obtained during the calibration pass itself.

The charger model mathematically predicts the voltage placed on the film by the charger grid. The unexposed film voltage $V_{black}$, is linear with charger grid voltage, $V_{grid}$. The exposure model estimates post-exposure film voltages ($V_{midtone}$and $V_{white}$) that occur in the exposed and less exposed areas on the film as a function of the actual exposures. These post-exposure film voltages are non-linear functions of the actual exposure. The decay model estimates the voltage decay experienced by the film once the film exits the exposure station. The decay is a linear function of the unexposed film voltage and is extrapolated from electrometer 84 to the development-toner station that will be used during the current toning pass using a time scaling multiplier. Lastly, the developer model predict the transmission density of the toned image given the working development voltage, WΔV. The transmission density is a linear function of the working development voltage.

Figures 18, 18A:
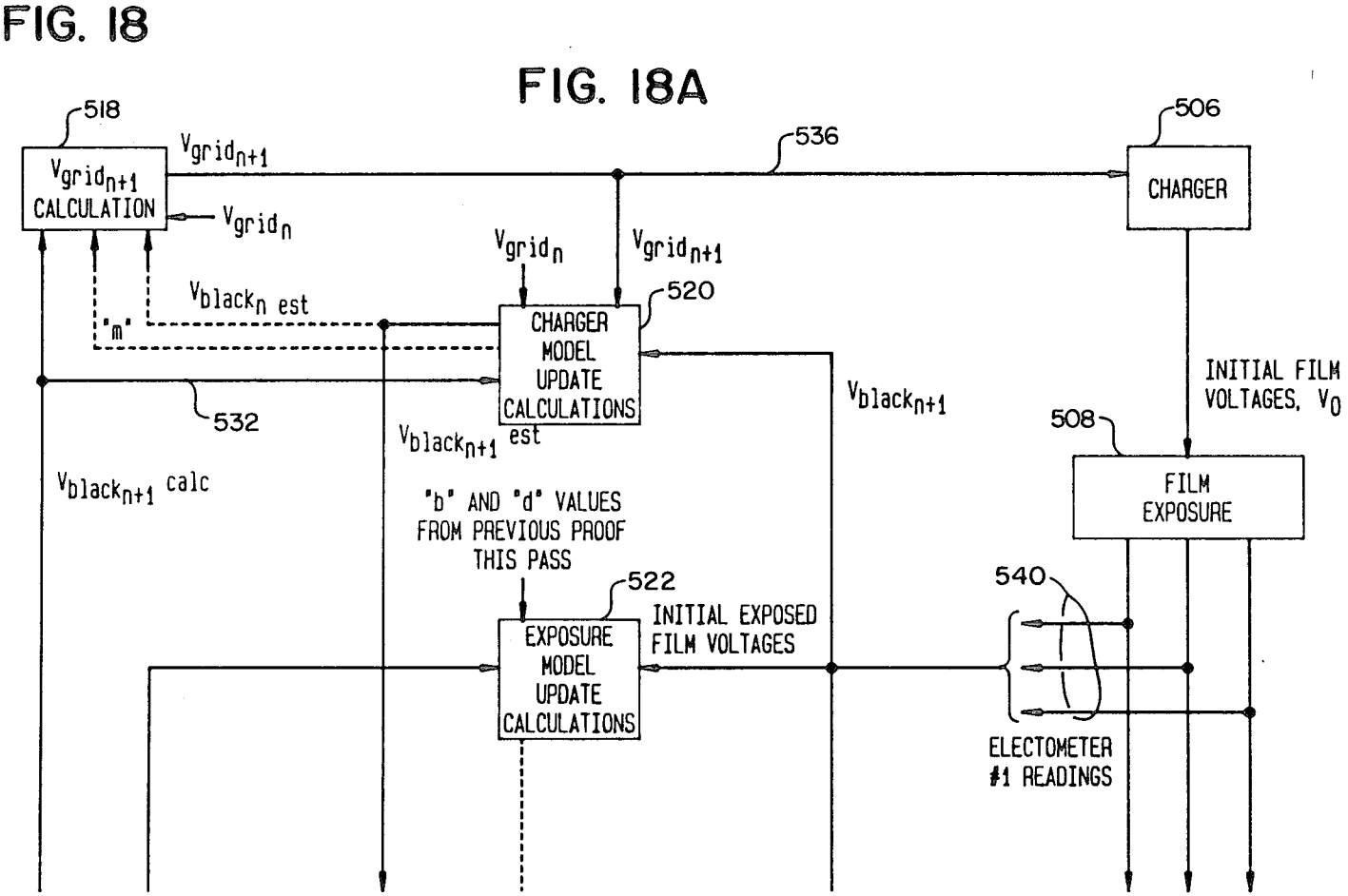
FIG. 18 is a diagram showing the proper alignment of the drawing sheets for FIGS. 17A–17C.
FIGS. 18A–18C collectively depict a detailed flowchart of the toning control algorithms used in the inventive system.
Figure 18B:
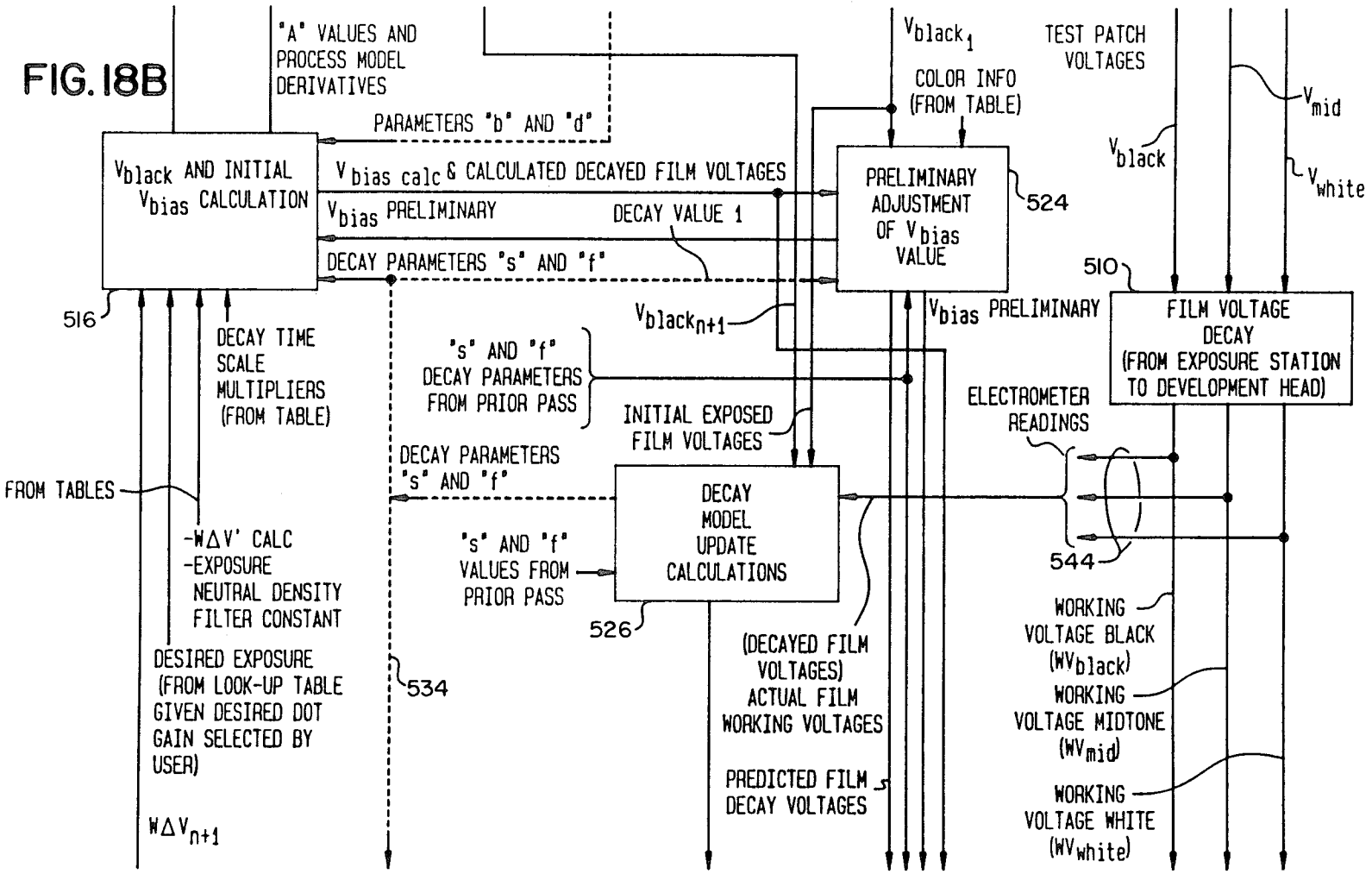
Figure 18C:
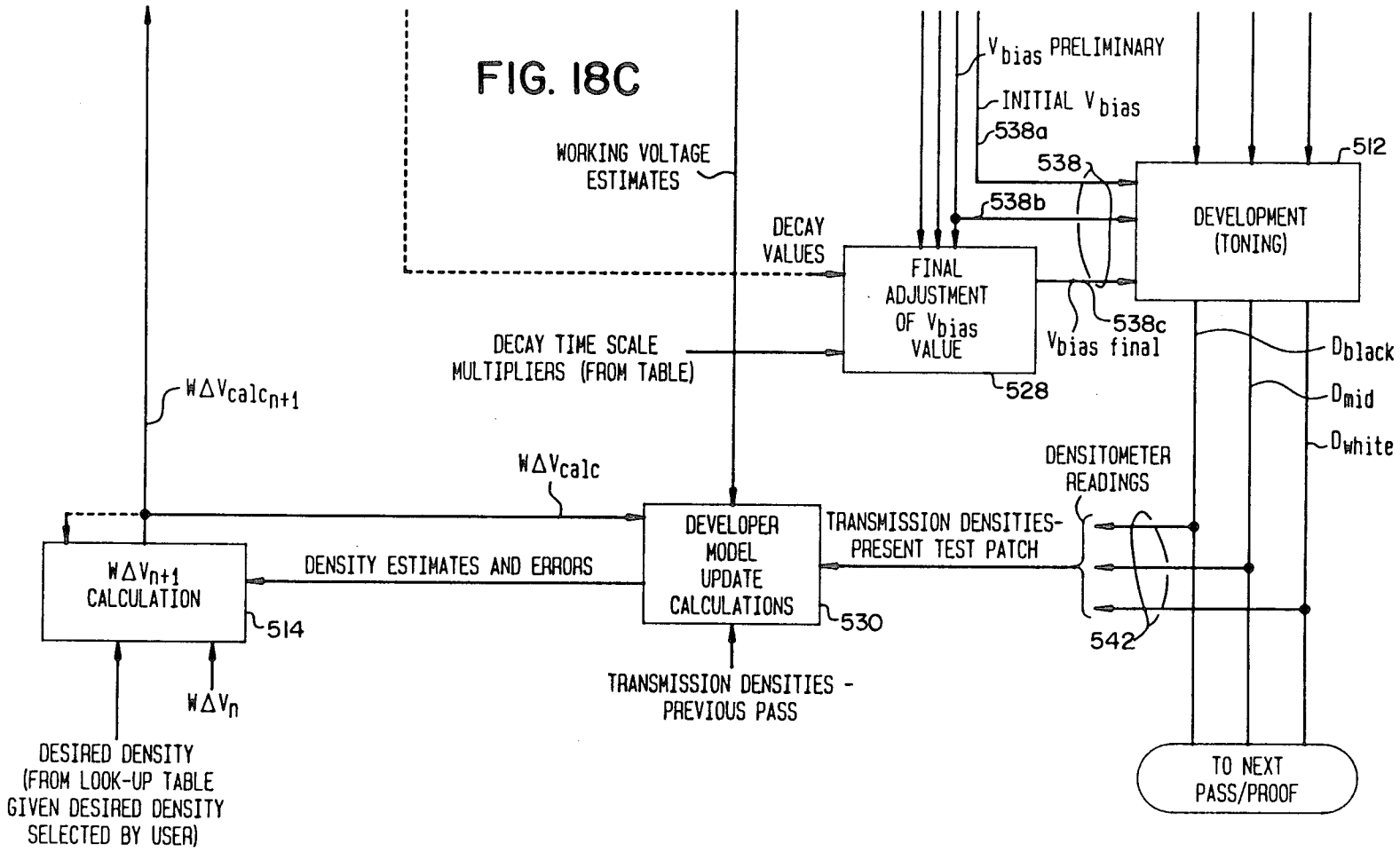

A detailed flowchart of the toning control algorithm used in the inventive system is shown in FIGS. 18A–18C, with the proper alignment of the drawing sheets for these figures shown in FIG. 18.

As shown, the four actual electro-photographic processes occurring in the proofing system are charging process 506, film exposure process 508, film voltage decay process 510 and development (or toning) process 512—all shown in the extreme right side of FIG. 18. The other boxes in this figure represent calculations. The process calculations responsible for providing toning control are working development voltage calculation 514, initial $V_{bias}$ and $V_{black}$calculation 516, $V_{grid}$ calculation 518, preliminary $V_{bias}$ adjustment 524, and final $V_{bias}$ adjustment 528. Update calculations to the four basic electro-photographic models are shown as charger model update calculations 520, exposure model update calculations 522, decay model update calculations 526 and developer model update calculations 530. The lines, either solid—e.g. line 532—or dashed—e.g. line 534, that connect each calculation box with another calculation box represent parameters that are passed between the separate calculations. Here, the solid lines represent parameters that are applied as input for use in other calculations for the current pass. By contrast, the dashed lines represent inter-pass or inter-proof parameters, i.e. parameters that are not used again for the current pass, but instead are stored for use during the next pass or for the same pass or same color occurring during the next proof. The solid lines that connect a calculation box to a process box represent a calculated value that sets a controlled process parameter, such as line 536 for $V_{grid}$ and lines 538 for $V_{bias}$.

Now, with this overview in mind, the discussion will now center on the specific calculations occurring during toning control.

Toning Control Calculations

To facilitate understanding of the calculations, the discussion will now assume that all the model parameters have already been updated, either because a calibration pass has just been completed or because a toning pass has just been concluded. Once all the toning control calculations have been discussed under this assumption, the discussion will then center on updating. The following discussion centers on the neg/pos mode. This discussion is equally valid for the pos/pos mode with inter-modal differences noted where applicable.

Inasmuch as no toning occurs during a calibration pass, preliminary $V_{bias}$ adjustment 524 and final $V_{bias}$ adjustment 528 are not performed during calibration. By contrast, all the process calculations are performed during a toning pass.

1. Working Voltage Calculations 514

The following voltages are used in these calculations:

$$W\Delta V = V_{bias} - (V_{image} - V_{decay})$$

Where $V_{image}$ is the exposed voltage $V_{white}$ in neg/pos mode and is the unexposed voltage $V_{black}$ in pos/pos mode. $V_{decay}$ is the decay in $V_{image}$ from the exit of the exposure station to the development toner station of the appropriate color.

The value, WΔV, as previously discussed, is the working voltage at the development-toner station which is responsible for toning the film as it passes over that station. As noted earlier, this voltage is responsible for setting the desired density.

To calculate the value of WΔV for the current pass (n+1), the developer model is used in the form:

$$W\Delta V_{n+1} = W\Delta V_n + (D_{n+1} - D_n)/\text{gamma} \quad (1)$$

In this model, a linear difference equation is used to relate the working development voltage for the current color to the working development voltage for the same color on the previous proof and the density difference, where $D_n$ represents the measured transmission density for the same color on the previous proof and $D_{n+1}$ represents the density desired by the user for the current proof. Gamma is the value for the slope of the line represented by equation (1) and is now taken to be a constant. The value of gamma is changed, if necessary, when the developer model is updated at the conclusion of the pass.

2. $V_{black}$ and Initial $V_{bias}$ Calculations 1320

Figure 19:
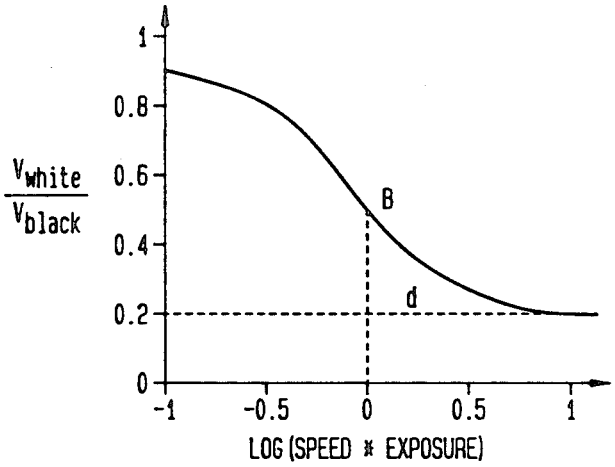
FIG. 19 graphically depicts the exposure model equation.

Now with WΔV calculated, the system now predicts the effect of exposure in the current pass. To do so, the exposure value E is obtained using a table look-up as previously described. Given the exposure value and various parameter values and constants, the exposure model is used to relate exposure to A, the ratio of exposed and unexposed voltages:

$$V_{white}/V_{black} = A = (1-d)e^{-(bE)} + d \quad (2)$$

where b is a parameter representing the film speed, c is a constant described below and d is a parameter representing the maximum limit of film discharge. This equation is graphically depicted in FIG. 19.

The film speed parameter b can be found from the discharge curve as the inverse of the exposure at which the maximum slope is obtained, i.e. the film speed point B. The maximum discharge parameter d is the lowest A value which can be obtained from exposing the film. The values of both b and d are updated at the conclusion of any toning pass. The value c is a fixed film dependent contrast parameter. The value of constant c is determined empirically and is not updated by the system. A table of appropriate c values is simply stored in memory and appropriately accessed by the exposure model. The value of c changes with pass and mode; therefore, the table contains appropriate c values given mode and pass information.

Now, at this point, the following equation is used to calculate the desired value of $V_{black}$:

$$V_{black\ (calc)} = \pm(W\Delta V + W\Delta V')/(1-A) \quad (3a)$$

(+for neg/pos mode, −for pos/pos mode)

except in the first pass of pos/pos mode wherein the differing decays in exposed and unexposed areas of the film require the use of the alternative expression:

$$V_{black\,(calc)} = -\frac{(W\Delta V + W\Delta V' + M_{color}(e-f))}{1 - A - M_{color}(R-S)} \quad (3b)$$

Here the different slopes of the decay model, R and S correspond to the different decays in the unexposed and exposed areas, respectively; similarly, for the different intercepts (e and f) of the decay model. The time scaling multiplier $M_{color}$ also appears in this expression.

The working background potential, $W\Delta V'$, is the difference between the bias voltage of the roller electrode of the development toner station and the non-image area decayed voltage as defined by the following equation:

$$W\Delta V' = (V_{nonimage} - V_{decay}) - V_{bias}$$

where $V_{nonimage}$ is $V_{black}$ in neg/pos mode and $V_{white}$ in pos/pos mode and $V_{decay}$ is the decay in the nonimage voltage. The voltage $W\Delta V'$ controls background noise. If this voltage becomes too small, then undesired toning will appear in non-image areas. The control process attempts to hold the magnitude of $W\Delta V'$ constant at approximately 100 volts in order to minimize background noise (100 volts for all passes in neg/pos mode, but in pos/pos mode: 55 volts for pass 1, and 50 volts for all subsequent passes).

To calculate an initial value of $V_{bias}$, the system requires data on the expected decay that will occur in the film voltage as the exposed film moves from the exposure station to the particular development toner station used during the current pass. Part of this data is in the form of constants called decay time scaling multipliers. Because decay is assumed to be a linear function of platen position, four decay time scaling multipliers ($M_{color}$) values are stored, each one for a different toning color. The appropriate multiplier is then accessed for the particular color that will be toned. In addition, decay voltage is linearly related to $V_{black}$ as set forth in equation (4*a*) below:

$$V_{decay} = S\,V_{black} + f \quad (4a)$$

except for the decay in the unexposed areas in first pass of pos/pos mode which is given by:

$$V_{decay} = RV_{black} + e \quad (4b)$$

where S and F (or R and e) are the slope and intercept points of the linear $V_{decay}/V_{black}$equation. Hereinafter, R and e will be referred to by implication whenever S and f are used for first pass pos/pos mode unexposed area decay. For the current pass, the values of S and f are accessed from a table that was updated at the conclusion of the previous pass with adjusted S and f values, as described below. Now, the initial value of $V_{bias}$ can be calculated as given by equation (5) below:

$$V_{bias}(\text{initial}) = W\Delta V + V_{image} - M_{color}V_{decay(calc)} \quad (5)$$

The value of $V_{decay(calc)}$ is a first estimate of the decay voltage and is obtained by substituting the calculated value of $V_{black\,(calc)}$, obtained from equation (3*a*) or (3*b*), into equation (4) for $V_{black}$. $V_{image}$ is $V_{white}$ in neg/pos mode and $V_{black}$ in pos/pos mode.

At this point, the initial value of $V_{bias}$is applied, as depicted by line 538*a*, to the roller electrodes at the selected development-toner station that will be used in the present pass and in the specific manner set forth in detail above.

3. $V_{grid}$ Calculations 418

Now with $V_{black(calc)}$ calculated and also the initial value of $V_{bias}$ calculated and applied to the roller electrodes, the value of voltage $V_{grid}$ for the current pass (n+1) can now be calculated as per equation (6) below:

$$V_{grid(n+1)} = V_{grid(n)} + m(V_{black(calc)} - V_{black(est)}) \quad (6)$$

where the m is a slope constant that relates the change in voltage $V_{black}$ to the change in grid voltage. The slope constant m is updated at the conclusion of the toning pass by charger model estimation 520. $V_{black(est)}$ and $V_{grid(n)}$ are the estimated value of $V_{black}$ and the set value of $V_{grid}$ from the previous pass in neg/pos mode and previous proof for the corresponding pass in pos/pos mode. The values are updated at the conclusion of every toning pass, as described in detail below in conjunction with charger model update calculations 520.

At this point, once the value $V_{grid(n+1)}$ has been calculated, the grid voltage is set to this value, as described in detail above. At approximately the same time, the exposure is also calculated and set as discussed above in conjunction with Exposure Set Routine 464. Thereafter, the platen moves the film through the charger and exposure stations.

4. Preliminary $V_{bias}$ Calculations 528

Now at this point, while the film is moving past the exposure station, measurements are being taken by electrostatic voltmeter 74 (see FIG. 14) on the actual film voltages present on the film test patches. These measurements, symbolized by lines 540 are fed to block 524 to adjust the initial $V_{bias}$ estimate both for the actual $V_{black}$ (and/or $V_{white}$) values and for the expected decay. This adjustment to $V_{bias}$ determined using equations (7) and (8*a* or 8*b*) below:

$$V_{decay(pred)} = S\,V_{black(measured)} + f \quad (7)$$

Now, using the predicted decay voltage: (for pos/pos mode)

$$V_{bias(prelim)} = V_{bias(initial)} + (V_{black(measured)} - V_{black(calc)}) - M_{color}(V_{decay(pred)} - V_{decay(calc)}) \quad (8a)$$

for neg/pos mode $$V_{bias(prelim)} = V_{bias(initial)} + (V_{white(measured)} - AV_{black(calc)}) - M_{color}(V_{decay(pred)} - V_{decay(calc)}) \quad (8b)$$

The bias voltage that is actually applied to the roller electrodes is then adjusted to this preliminary value, as symbolized by line 538*b*.

5. Final $V_{bias}$ Adjustments

Now, except for yellow toning passes, the non-image test patch and, for some colors, the image test patch voltages have been read by both electrometers, and thus measured decays can be calculated as per equation (9) below:

$$V_{decay(measured)} = V_{74} - V_{84} \quad (9)$$

The decay values are now used to make a preliminary estimate of the decay model parameters S and f as in block 526 described below. This produces a new decay estimate, $V_{decay(est)}$, which is a weighted average between the predicted decay $V_{decay(pred)}$ and the measured decay(s). The averaging weights used are calculated as in block 526.

With the new estimated decay voltage, the bias voltage is compensated for any differences occurring between the estimated and predicted decay values as per the following equation, in order to yield a final value for $V_{bias}$:

$$V_{bias(final)} = V_{bias(prelim)} - M_{color}(V_{decay(est)} - V_{decay(pred)}) \quad (10)$$

This final $V_{bias}$ value is applied, in the manner set forth in detail above, to the roller electrodes in use for the current pass as symbolized by line 538c.

The film is now toned. At this point, the actual transmission densities of all the film test patches (exposed, unexposed and midtone) are measured to provide a measurement of the actual density of the toned image on the film.

C. Model Update Calculations

1. Overview of Parameter Estimation Methods

There are three methods used for the estimation of parameters. One, used in developer model estimation, is direct solution of the model equation for the parameter of interest on the basis of measured values. This method will be described in detail in the section on developer model update calculations to follow.

The second estimation method is nonlinear least squares. This method is used in exposure model estimation on a calibration pass. The two parameters of interest are estimated by fitting the model to three data points. The details of this method will be discussed in the contest of the exposure model update calculation used for a calibration pass.

The third method, used in all other estimation situations, is adapted from the variable forgetting factor recursive least squares algorithm developed by Dr. B. E. Ydstie at Imperial College in London. See for example B. E. Ydstie et al, "Recursive Estimation of Adaptive Divergence Control", University of Massachusetts Technical Report No. UMASS CHE 84-YD-1R, November 1984, hereinafter referred to as Ydstie. The calculations specific to each of the estimation blocks will be outlined in detail in the discussion of each block. The general form of the method is given in the following section.

2. Overview of Variable Forgetting Factor Recursive Least Squares

This variant of the well-known Kalman filter algorithm is based on the idea of maintaining a constant level of information in the covariance matrix of the parameter uncertainties. This is accomplished by calculating a factor which assesses the novelty of a measurement. The more unexpected the measured value is, the more weight it is given relative to the old data. This results in smooth operation under normal conditions since more old data is then maintained and quicker adaptation to novel conditions since the old data is then forgotten (see Ydstie).

The general form of this filtering algorithm as applied to scalar measurements is described by the following set of equations:

Prediction:

$$x_{predicted} = \phi x_{old} \quad (11a)$$

$$P = \phi P \phi^T \quad (11b)$$

$$y_{predicted} = h(x_{predicted}) \quad (11c)$$

Linearization (if necessary):

$$H = (dh/dx) \quad (11d)$$

Prediction error:

$$\text{error} = e = y_{measured} - y_{predicted} \quad (11e)$$

$$\text{variance} = V = R + HPH^T \quad (11f)$$

Calculation of forgetting factor:

$$ff = N / (N + e^2/V) \quad (11g)$$

Gain calculation:

$$K = (HPH^T + ff\,R)^{-1} PH^T \quad (11h)$$

Update of parameters:

$$x_{new} = x_{predicted} + Ke \quad (11i)$$

Update of parameter covariance matrix:

$$P = (I - KH)P/ff \quad (11j)$$

In equations (11*a*) through (11*j*), y represents the measured response(s), x the parameter(s), $\phi$ the parameter transition matrix, P the covariance matrix of the parameters, H the linearization of the model equation h, R the covariance matrix of the measurement errors and N the effective filter memory length (which serves as a tuning parameter).

In order to avoid the potential difficulties of using this algorithm directly on a short word length computer, the covariance matrix P is used and computed throughout in the $UDU^T$ factorized form where U is an upper triangular matrix with ones on the diagonal and D is a diagonal matrix. (See P. S. Maybeck, *Stochastic Models, Estimation and Control* (©, 1979 Academic Press, Orlando), pp. 392–394.)

3. Charger Model Update Calculations 520

These calculations occur after either a toning or calibration pass. The two parameters estimated by these calculations are $V_{black}$ and the inverse of the slope m of the charger model. Both of these parameters are used in the calculation of $V_{grid}$ in the previously described calculation block 518. The estimated value of $V_{black}$ from this block is also used in the decay model update calculation block 526 which will be discussed in detail below. The calculations of this block proceed according to the $UDU^T$ factorized form of the variable forgetting factor algorithm outlined above.

The prediction step of the algorithm, following the procedure of equations (11*a*) through (11*c*), can be expressed by equations (12*a*) through (12*d*) using the old values, $V_{black(est)}(1/m)_{(est)}$ and $V_{grid(n)}$, obtained from memory:

$$V_{black(pred)} = V_{black(est)} + (V_{grid(n+1)} - V_{grid(n)})(1/m)_{est} \quad (12a)$$

$$(1/m)_{(pred)} = (1/m)_{(est)} \quad (12b)$$

Note that since the new value of $V_{grid}$ is calculated in calculation block 518 to precisely yield the desired value of $V_{black}$ as calculated in block 516, i.e. $V_{black(calc)}$, equation (12*a*) is redundant and is shown here only to justify the calculation used to produce the covariance matrix of predictions $V_{black(pred)}$ and $(1/m)_{(pred)}$.

Since the implied parameter transition matrix $\phi$ used in equations (12*a*) and (12*b*) is unit upper triangular, the $UDU^T$ form of the update of P corresponding to equation (11*b*) is accomplished by multiplying $\phi$ times U, which only requires the recomputation of the off diagonal element of U, u, via the equation:

$$u=u+V_{grid(n+1)}-V_{grid(n)} \quad (12c)$$

Then the measured value is predicted as in equation (11*c*) to yield:

$$V_{black(meas\ pred)}=V_{black(pred)} \quad (12d)$$

This completes the prediction step of the algorithm.

The row vector H implied in equation (12*d*), which corresponds to the model derivative calculation (11*d*), is simply H=[1 0 ].

Next, the prediction error and the variance of the prediction error are computed. The prediction error equation equivalent to equation (11*e*) is:

$$\mathrm{err}=V_{black(meas)}-V_{black(meas\ pred)} \quad (12e)$$

and the variance of the prediction error, which is equivalent to equation (11*f*), is:

$$V=R+d_1+d_2u^2 \quad (12f)$$

where $d_1$ and $d_2$ are the diagonal elements of the D factor of P and R is the appropriate variance of the measured value of $V_{black}$ which will be discussed later.

Next, the forgetting factor, ff, is calculated as in equation (11*g*) by:

$$ff=N/(N+\mathrm{err}^2/V) \quad (12g)$$

Then the gains to be used in the update equations are calculated as per equation (11*h*):

$$\mathrm{gain}_{(Vblack)}=(d_1+d_2u^2)/(ffR+d_1+d_2u^2) \quad (12h)$$

$$\mathrm{gain}_{(1/m)}=(d_2u)/(ffR+d_1+d_2u^2) \quad (12i)$$

Next, the parameters are updated as in equation (11*i*) by using the following equations:

$$V_{black(est)}=V_{black(predicted)}+\mathrm{gain}_{(Vblack)}\ \mathrm{err} \quad (12j)$$

$$(1/m)_{(est)}=(1/m)_{(pred)}+\mathrm{gain}_{(1/m)}\ \mathrm{err} \quad (12k)$$

Finally, the $UDU^T$ factors of P are updated as an equation (11*j*) by:

$$d_2=d_2\,(1-\mathrm{gain}_{(1/m)}u)/ff \quad (12l)$$

$$u=R\ \mathrm{gain}_{(1/m)}/d_2 \quad (12m)$$

$$d_1=R(1-\mathrm{gain}_{(Vblack)})/ff-d_2u^2 \quad (12n)$$

The updated values of the parameters and covariance matrix factor elements are then stored in memory for later use.

For toning passes, the value used for R, stored in ROM 340 (see FIG. 14*c*) represents the variance of a single electrometer reading. Since a calibration pass produces three unexposed test patches, the values associated with these test patches are averaged to obtain the measured value used in the algorithm above. Therefore, the value used for R for charger model update calculations for a calibration pass is one-third of that used for updating the charger model for a toning pass.

4. Exposure Model Update Calculations 522

These calculations used measured voltages to estimate two parameters of the exposure model, namely b and d, and their covariance matrix factorization. The algorithms used in calibration and toning passes are distinct as noted in the overview of the model update calculations above. Although both algorithms are members of the least squares family, that used in a calibration pass calculates totally fresh estimates whereas that used in toning passes does not totally disregard past history, i.e. old parameter estimates.

The method used in calibration passes is a well-known nonlinear least squares algorithm which uses as its computational core a QR factorization of the model derivative matrix H defined in equation (11*d*). The core calculations are performed as described in G. H. Golub and C. L. VanLoan, *Matrix Computations,* (© 1983, The Johns Hopkins University Press, Baltimore) pp. 152ff. Since the speed parameter b is nonlinearly involved in the exposure model, the full algorithm consists of linearizing the model about an initial set of parameter values, using the aforementioned linear least squares core to calculate an updated set of parameters and repeating this procedure until convergence is obtained. After the converged parameters are obtain, the final set of QR factors are used to obtain the well-known estimate of the covariance matrix of the parameters based on an estimate of the covariance matrix of the measurement errors. This matrix is then factorized into $UDU^T$form for use during toning passes.

In calibration passes, the nine test patches are given four levels of exposure; three are unexposed, two are exposed with no test patch filters interposed between the test patch and the exposure lamp, two with a single test patch filter interposed and two with both test patch filters interposed. The exposures delivered to the six exposed areas are chosen to obtain good estimates of the model parameters. Measured voltage values of corresponding patches are averaged together and then three A values are calculated by forming the ratios of the exposed voltages to the unexposed voltage. These three measured values are then fit in a least squares sense by the aforementioned nonlinear least squares algorithm, producing the parameter and parameter covariance estimates.

The method used during toning passes is a variant of the variable forgetting factor algorithm described above but adapted to the case of multiple measurements. In this variant, the model derivative matrix and the prediction errors are premultipled by a matrix to be described below to obtain values which can be processed by the scalar algorithm. An additional variation is the use of two separate memory lengths (and forgetting factors) for the parameters b and d to reflect their relative levels of variability. Other than these two variations, the method used is very similar to that used in the charger model update calculations.

Specifically, the prediction phase calculations are first performed. In this situation, the parameter transition matrix, $\phi$, is an identity matrix since the predicted parameter values are the old values. Thus, neither equation (11*a*) nor (11*b*) needs to be calculated. The two predicted A measurements corresponding to equation (11*c*) are calculated via the exposure model equation (2) using the parameter values, the exposure used to expose the film and that exposure as attenuated by the midtone filter(s) used.

Next, the linearization of the model is computed by substituting the aforementioned parameter and exposure values into the analytically derived expressions for the derivative of the model with respect to the parameters. These four values comprise the model matrix H. with the rows indexed by exposure level and the columns by parameter value.

Next, the predicted values of the voltage ratios are subtracted from the A values calculated from the ratios of the measured exposed and unexposed voltages to form a column vector e of measurement errors.

Since the two ratios are computed using the same measured value of unexposed voltage and since the two exposures which gave rise to the observed ratios are constant multiples of each other, the errors induced by these common disturbance sources cause a correlation in the measurement errors associated with the A values. Thus in this case, not only is R not a scalar, it is not even a diagonal matrix. However, the $UDU^T$ factorization of R can be computed and used to reduce the problem to an equivalent one which has a diagonal measurement covariance matrix. Once this uncorrelated form is obtained, the two transformed measurements may be processed by the scalar algorithm in turn. In particular, if we define the matrix H and the column vector e by the matrix expressions $H=U^{-1}H$ and $e=U^{-1}e$, then the entries of e and the corresponding rows of H together with the corresponding diagonal element of D (which serves in the place of R) can be processed through the remaining portions of the forgetting factor algorithm (equations (11*e*) through (11*j*)).

The second variation used is the application of multiple forgetting factors. In this variation, rather than multiplying R by the forgetting factor when calculating the gains and dividing P (or equivalently, D) by the forgetting factor when updating the parameter covariance matrix, a generalization of the equivalent formulation, wherein P (or equivalently, D) is divided by the forgetting factor prior to the gain calculation, is used. Two separate forgetting factors based on the same prediction error and prediction error variance but having differing filter memory lengths, N, are computed. These factors are placed on the diagonal of a matrix F, and subsequently P is multiplied on the left and right by the diagonal inverse square root of F. In the $UDU^T$ form of the algorithm actually used, this step is accomplished by the equations:

$$d_1=d_1/f_1,\ d_2=d_2/f_2 \text{ and } u=u(f_2/f_1)^{\frac{1}{2}}.$$

After this computation, the remainder of the algorithm is carried out using equations equivalent to equations (11*h*) through (11*j*) appropriate for the $UDU^T$ form with the forgetting factor set to 1.

5. Decay Model Update Calculations 526

These calculations occur after either a toning or calibration pass. The parameters estimated by these calculations are the slopes(s) S and the intercept(s) f of the decay model(s). These parameters are used in the previously described calculation block 516. The estimated values of working voltage from this block described below are also used in the developer model update calculation block 530 discussed in detail below. The calculations of decay model update block 526 proceed according to the $UDU^T$ factorized form of the variable forgetting factor algorithm outlined above.

The prediction step of the algorithm generically specified by equations (11*a*) through (11*c*) is accomplished using $\phi$ as an identity matrix and by the decay model equation and the value of $V_{black(est)}$ provided by charger model update calculations 520, as per the following equation:

$$V_{decay(meas\ pred)}=S_{(pred)}V_{black(est)}+f_{(pred)} \tag{13a}$$

This completes the prediction step of the algorithm.

The row vector H implied in equation 13*a* which corresponds to the model derivative calculation (11*d*) is simply $H=[V_{black(est)}\ 1\ ]$.

Next, the prediction error and the variance of the prediction error are computed. The prediction error equation equivalent to equation (11*e*) which uses the measured decay is explained in detail below:

$$\text{err}=V_{decay(meas)}-V_{decay(meas\ pred)} \tag{13b}$$

and the variance of the prediction error equation equivalent to equation (11*f*) is:

$$V=R+d_1+d_2(u+V_{black(est)})^2 \tag{13c}$$

where $d_1$ and $d_2$ are the diagonal elements of the D factor of P, u is the off diagonal element of U and R is the appropriate variance of the measured value of $V_{decay}$ which will also be discussed later.

Next the forgetting factor is calculated as in equation (11*g*) by:

$$ff=N/(N+\text{err}^2/v) \tag{12g}$$

Then the gains to be used in the update equations are calculated by equations equivalent to equation (11*b*), namely:

$$V_{total}=ff\,R+d_1+d_2(u+V_{black(est)})^2 \tag{13d}$$

$$\text{gain}_{(S)}=d_1\,(u+V_{black(est)})/V_{total} \tag{13e}$$

$$\text{gain}_{(f)}=d_2/V_{total}+u\ \text{gain}_{(S)} \tag{13f}$$

$$S_{(est)}=S_{(pred)}+\text{gain}_{(S)}\ \text{err} \tag{13g}$$

$$f_{(est)}=f_{(pred)}+\text{gain}_{(f)}\ \text{err} \tag{13h}$$

$$V_{subtotal}=ff\,R+d_2 \tag{13i}$$

$$u=u-d_2\,(u+V_{black(est)})/V_{subtotal} \tag{13j}$$

$$d_2=d_2R/V_{subtotal} \tag{13k}$$

$$d_1=d_1V_{subtotal}/V_{total} \tag{13l}$$

The updated values of the parameters and covariance matrix factor elements are then stored in memory for later use.

There are six different cases of calculations performed by block 526, depending upon mode, pass and type of pass from which data is taken. For the first case, toning passes of neg/pos mode or toning passes after the first pass of pos/pos mode, the decay measurement used above is the average of the three voltage differences from electrometer 74 to electrometer 84 of the white, midtone and black test patches. If the toning pass is the first pass in pos/pos mode, the algorithm is executed twice to estimate the different slope and intercept parameters, S and f, used for decays on unexposed and exposed areas separately. In these two cases, the two decays measured on exposed (white and midtone) test patches are averaged and the measured decay on the unexposed test patch is processed as is.

Corresponding to the three cases above, the value of R used is $\frac{1}{3}$, 1 and 2 times the stored value of the electrometer variance.

When calibration passes occur, which are always the first pass of the proof, there are 3 analogous cases. In neg/pos mode, the decays of all 9 test patches are averaged and R is 2/9 times the stored variance. In the second case, in pos/pos mode, the decays of the six exposed test patches are averaged and R is $\frac{1}{3}$ of the stored variance. In the third case, in pos/pos mode, the decays of the three unexposed test patches are averaged and R is $\frac{2}{3}$ of the stored variance.

After the parameters are estimated and stored in toning passes, the working voltages (WV) of the test patches are calculated by the equations:

$$WV_{midtone} = V_{midtone(meas)} - M_{color} V_{decay(midtone\ est)} \quad (14)$$

$$WV_{image} = V_{image} - M_{color} V_{decay(image\ est)} \quad (15)$$

wherein the decay estimates are based on the appropriate parameter estimates and $V_{black(est)}$ and $V_{image}$ is either the measured value of $V_{white}$ in neg/pos mode or the estimated value $V_{black(est)}$ in pos/pos mode. The measured values used here are those obtained from electrometer 74.

6. Developer Model Update Calculations 530

All the actual transmission density measurements are applied, as symbolized by lines 542, to developer model update calculations 530 to update the developer model parameters. Inasmuch as density varies linearly with working voltage, the actual value of the slope gamma (see equation (1)) above) can be determined using two actual data points: the actual transmission density for a completely exposed test patch, $D_{trans(image)}$, and the actual transmission density for a partially exposed test patch, $D_{trans(midtone)}$, along with the corresponding estimated working voltage values for these test patches provided by block 526 above. Partial exposure is obtained using the test patch neutral density filters, as discussed above. The densities of the filters are chosen to assure that the measured differences in densities and voltages between a full density and a midtone test patch are sufficiently large to afford a relatively noise-free estimate of the slope parameter, gamma. The following equation is used to re-calculate gamma:

$$\text{gamma} = \frac{D_{\text{trans(image)}} - D_{\text{trans(midtone)}}}{\text{abs}(WV_{image} - WV_{midtone})} \quad (16)$$

If a midtone patch is not available, then values of $D_{trans(midtone)}$ and $WV_{midtone}$ are both set to zero. The resulting value of gamma is stored in memory for use for that color during the next proof. A separate value of gamma is stored for use for each color. Hence, during any proof, separate new values of gamma are calculated for each toned color and stored for use during the following proof.

Inasmuch as no toning occurs during a calibration pass, the developer model update calculations are not performed during calibration. These calculations are only performed at the conclusion of each toning pass.

Although a specific illustrative embodiment has been shown and described herein, this merely illustrates the principles of the present invention. Clearly, many varied arrangements embodying these principles may be devised by those skilled in the art without departing from the spirit and scope of the present invention.

What is claimed is:

1. An electrophotographic proofing apparatus for use with a member having a photoconductive surface, said apparatus comprising:

means for applying a charge potential on the photoconductive surface of such a member;

exposing means for projecting along an optical path, a single color light image corresponding to a first color separation, onto such photoconductive surface to form an electrostatic separation image on such surface;

means for selectively disposing density controlling shutter members into said optical path during exposure to form electrostatic images of respective test patches on such surface;

means for sensing the potential of said test patch images on such surface and for producing a first output signal corresponding to such potential;

means for developing the electrostatic separation image and test patch images on such surface with toner particles complementary in color to the first color separation to form a visible representation of the electrostatic separation image and test patch images;

means for sensing the density of at least one of the visible test patch images and for producing a second output signal corresponding to such density; and means responsive to said output signals for optimizing both the processing of the separation image formed from the first color separation and the subsequent processing of an image formed by exposing the same photoconductive surface after recharging, to a second light image corresponding to a second color separation.

2. An electrostatic proofing apparatus as recited in claim 1 wherein said density controlling shutter members include:

a first maximum density shutter member;

a second mid-density shutter member further including a neutral density filter.

3. An electrophotographic proofing apparatus as recited in claim 1 wherein said means for sensing the potential of electrostatic latent density test patches comprises an electrostatic voltmeter.

4. An electrophotographic proofing apparatus for use with a member having a photoconductive surface, said apparatus comprising:

means for applying a charge potential on the photoconductive surface of such a member;

exposing means for projecting along an optical path, a single color light image corresponding to a first color separation, onto such photoconductive surface to form an electrostatic separation image on such surface;

means for selectively disposing density controlling shutter members into said optical path during exposure to form electrostatic images of respective test patches on such surface;

first means located proximate said exposing means for sensing the potential of said test patch images on such surface and for producing a first output signal corresponding to such potential;

second means spaced from said exposing means, for sensing the potential of said test patch images after said first sensing occurs on such surface and for producing a second output signal corresponding to such potential;

means for developing the electrostatic separation image and test patch images on such surface with toner particles complementary in color to the first color separation to form a visible representation of the electrostatic separation image and test patch images;

means for sensing the density of at least one of the visible test patch images and for producing a third output signal corresponding to such density; and means responsive to said output signals for optimizing both the processing of the separation image formed from the first color separation and the subsequent processing of an image formed by exposing the same photoconductive surface after recharging, to a second light image corresponding to a second color separation.

5. An electrostatic proofing apparatus as recited in claim 4 wherein the difference between said first output signal and said second output signal is used to determine the voltage decay rate of said photoconductive surface.

6. An electrostatic proofing apparatus as recited in claim 4 wherein said density sensing means is a transmissive densitometer.

7. An electrostatic proofing apparatus as recited in claim 4 wherein said third output signal is placed in memory means and used later to optimize the toning of a corresponding color in a subsequent proofing operation.

8. An electrostatic proofing apparatus as recited in claim 4 wherein said development means further includes a toning electrode for each complementary toning color.

9. An electrostatic proofing apparatus as recited in claim 8 wherein said first and second output signals are used to adjust the voltage on said toning electrode for the color being toned.

* * * * *